US012304705B2

(12) United States Patent
Chen et al.

(10) Patent No.: US 12,304,705 B2
(45) **Date of Patent: *May 20, 2025**

(54) ONE- AND TWO-PACK BEVERAGE BOX

(71) Applicant: Pratt Corrugated Holdings, Inc., Brookhaven, GA (US)

(72) Inventors: Shifeng Chen, Newport News, VA (US); Greg Sollie, Sharpsburg, GA (US); Jamie Waltermire, Peachtree City, GA (US)

(73) Assignee: Pratt Corrugated Holdings, Inc., Brookhaven, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/631,910

(22) Filed: Apr. 10, 2024

(65) Prior Publication Data

US 2024/0270438 A1 Aug. 15, 2024

Related U.S. Application Data

(60) Division of application No. 17/682,987, filed on Feb. 28, 2022, now Pat. No. 11,993,431, which is a (Continued)

(51) Int. Cl.
*B65D 5/50* (2006.01)
*B65D 5/10* (2006.01)
(Continued)

(52) U.S. Cl.
CPC ..... *B65D 5/5014* (2013.01); *B65D 5/106* (2013.01); *B65D 5/3621* (2013.01); *B65D 5/4204* (2013.01); *B65D 5/4608* (2013.01)

(58) Field of Classification Search
CPC ..... B65D 5/14; B65D 5/0245; B65D 2571/0029; B65D 5/46096; B65D 5/10;
(Continued)

(56) References Cited

U.S. PATENT DOCUMENTS 956,046 A 4/1910 Davis
1,167,847 A 1/1916 Schoettle
(Continued)

FOREIGN PATENT DOCUMENTS

EP 3056443 8/2016
FR 2769892 4/1999
(Continued)

OTHER PUBLICATIONS

Chen, Shifeng; Corrected Notice of Allowance for U.S. Appl. No. 16/903,440, filed Jun. 17, 2020, mailed Jul. 9, 2021, 6 pgs.
(Continued)

*Primary Examiner* — Christopher R Demeree
(74) *Attorney, Agent, or Firm* — Taylor English Duma LLP

(57) ABSTRACT

A box can include a body portion at least partially defining a cavity, the body portion defining a top body end and a bottom body end, the body portion including a plurality of panels, the top body end defining an opening to the cavity; a telescoping panel including an upper telescoping subpanel and a lower telescoping subpanel, the lower telescoping subpanel coupled to the body portion by a top hinge, the upper telescoping subpanel coupled to the lower telescoping subpanel by a telescoping hinge, the lower telescoping subpanel extending into the cavity and positioned in facing engagement with a first panel of the plurality of panels, the upper telescoping subpanel extending across the cavity from the first panel to a second panel of the plurality of panels, the second panel positioned opposite from the first panel; and a bottom portion coupled to the bottom body end by a bottom hinge.

20 Claims, 24 Drawing Sheets

Related U.S. Application Data continuation of application No. 16/903,460, filed on Jun. 17, 2020, now Pat. No. 11,472,596.

(51) Int. Cl.
*B65D 5/36* (2006.01)
*B65D 5/42* (2006.01)
*B65D 5/468* (2006.01)

(58) Field of Classification Search
CPC .. B65D 5/4608; B65D 5/4204; B65D 5/3621; B65D 5/106; B65D 5/5014
USPC ..... 229/120.08, 120.18, 157, 127, 120.13, 229/162.3, 162.7; 222/93; 206/194, 427, 206/549, 562, 565, 588
See application file for complete search history.

(56) References Cited

U.S. PATENT DOCUMENTS 1,682,838 A 9/1928 Feigelman
1,898,646 A 2/1933 Taylor
1,917,132 A 7/1933 Labombarde
1,930,235 A 10/1933 Fox
1,976,530 A 10/1934 Verhoven
2,034,809 A 3/1936 Grant
2,157,954 A 5/1939 Gould
D129,731 S 9/1941 Luttrell
2,325,277 A 7/1943 Rothe et al.
2,464,951 A 3/1949 Stengren
2,531,090 A 11/1950 Turner
2,537,151 A 1/1951 Mires
2,643,811 A 6/1953 Bolding
2,653,742 A 9/1953 Currie
2,698,126 A 12/1954 Belsinger
2,719,650 A 10/1955 Buttery et al.
2,937,743 A 5/1960 Buttery et al.
2,947,462 A 8/1960 Bostock
2,965,278 A 12/1960 Phillips
3,003,620 A 10/1961 Srofe
3,014,635 A 12/1961 Mairs et al.
3,047,204 A 7/1962 Wolowicz
3,049,279 A 8/1962 Mairs et al.
3,119,544 A 1/1964 Cope et al.
D198,411 S 6/1964 Hanopole
3,173,596 A 3/1965 Aust et al.
3,178,242 A 4/1965 Ellis et al.
3,194,480 A 7/1965 Maindron et al.
3,198,379 A 8/1965 Creelman
3,206,098 A 9/1965 Stenger et al.
3,315,931 A 4/1967 Puckett
3,349,986 A 10/1967 Chapman et al.
3,400,879 A 9/1968 O'brien et al.
3,443,736 A 5/1969 Steinbock
3,563,449 A 2/1971 Forbes, Jr.
3,591,070 A 7/1971 Vrana
3,670,949 A 6/1972 Galanes
3,827,550 A 8/1974 Arneson
4,010,888 A 3/1977 Gilbert
4,088,262 A 5/1978 Kuehlhorn
4,133,474 A 1/1979 Hall
4,164,315 A 8/1979 Pennanen
4,260,059 A 4/1981 Roccaforte
D262,946 S 2/1982 Mills et al.
4,318,470 A 3/1982 Montealegre
4,318,476 A 3/1982 Wood et al.
D265,723 S 8/1982 Rosenthal
4,345,687 A 8/1982 Davidson
4,353,495 A 10/1982 Jes
4,377,252 A 3/1983 Schillinger
4,389,013 A 6/1983 Hall et al.
4,394,905 A 7/1983 Hackenburg
4,482,055 A 11/1984 Boyle
4,541,560 A 9/1985 Fischer
D290,343 S 6/1987 Osborne
D290,444 S 6/1987 Osborne
4,756,469 A 7/1988 Hansen
4,778,055 A * 10/1988 Kiedaisch ..... B65D 71/00 229/120.08
D301,980 S 7/1989 Shih
4,892,223 A 1/1990 Dement
D307,109 S 4/1990 Dasher et al.
D309,262 S 7/1990 Coiner
D318,802 S 8/1991 Egide
5,044,548 A 9/1991 Olsen et al.
5,065,937 A 11/1991 Ritter
D329,375 S 9/1992 Bergman
5,161,732 A 11/1992 Clein et al.
5,186,359 A 2/1993 Brown et al.
5,284,291 A 2/1994 Sellors
5,314,224 A 5/1994 Bates
5,413,274 A 5/1995 Forbes, Jr.
D360,131 S 7/1995 Tudor
D364,087 S 11/1995 Farley
5,465,834 A 11/1995 Sieber et al.
D369,749 S 5/1996 English
D371,959 S 7/1996 Hupp
D372,423 S 8/1996 Cook
D373,080 S 8/1996 Prosperi et al.
5,579,904 A 12/1996 Holley, Jr.
5,582,343 A 12/1996 Dalvey
5,584,430 A 12/1996 Mulry
D384,276 S 9/1997 Casey et al.
5,680,930 A 10/1997 Stone
5,687,902 A 11/1997 Tusing et al.
5,690,275 A 11/1997 Bose et al.
5,722,584 A 3/1998 Fujiwara
5,772,107 A 6/1998 Younger
D396,187 S 7/1998 Harrison
D398,229 S 9/1998 Herbst et al.
5,816,411 A 10/1998 Smith
5,860,555 A * 1/1999 Mayled ..... A61B 50/36 229/148
D420,575 S 2/2000 Rovere
D430,437 S 9/2000 Shimbo et al.
D436,313 S 1/2001 Joshua et al.
D461,120 S 8/2002 Ostro
6,460,703 B1 10/2002 Thompson et al.
6,755,324 B2 6/2004 Geshay
D495,953 S 9/2004 Miller
6,802,802 B2 10/2004 Woog
D528,926 S 9/2006 Blin
D542,129 S 5/2007 Moorman
7,306,136 B2 12/2007 Mckenna et al.
7,314,158 B2 1/2008 McKenna, Sr. et al.
D578,883 S 10/2008 Kisch
7,475,772 B2 1/2009 Cuomo
D587,998 S 3/2009 Kaisanlahti et al.
7,578,385 B2 8/2009 Holley, Jr.
7,607,565 B2 10/2009 Noguchi
D608,634 S 1/2010 Riedi
D618,543 S 6/2010 Polaski et al.
7,753,196 B2 7/2010 Cuomo
D651,076 S 12/2011 Van Berlo
8,220,633 B2 7/2012 Weideman
8,490,785 B2 7/2013 Brand
D689,360 S 9/2013 Adams
D690,593 S 10/2013 Kaps et al.
D702,546 S 4/2014 Mcadam
8,746,541 B2 6/2014 Spivey, Sr. et al.
8,746,543 B2 6/2014 Jolley et al.
D709,363 S 7/2014 Boehnen et al.
D724,940 S 3/2015 Kim et al.
D744,332 S 12/2015 D'Anglade
9,212,842 B2 12/2015 Vasbinder et al.
D749,944 S 2/2016 Kummerfeldt
D764,315 S 8/2016 Rachocki
9,415,914 B2 8/2016 Holley, Jr.
9,540,132 B1 1/2017 Lee
D787,934 S 5/2017 Bore
9,708,112 B2 7/2017 Sutherland et al.
D797,554 S 9/2017 Bankowski
9,770,880 B2 9/2017 Schuster
D805,894 S 12/2017 Lee

(56) References Cited

U.S. PATENT DOCUMENTS

| | | | |
|---|---|---|---|
| D808,258 | S | 1/2018 | Lee |
| 9,975,664 | B2 | 5/2018 | Fath |
| D822,480 | S | 7/2018 | Rivera |
| 10,173,804 | B2 | 1/2019 | Zacherle |
| 10,301,090 | B2 | 5/2019 | Holley, Jr. |
| 10,329,048 | B2 | 6/2019 | Nelson et al. |
| 10,414,537 | B2 | 9/2019 | Imai et al. |
| D863,056 | S | 10/2019 | Luna |
| 10,427,827 | B2 | 10/2019 | Bitowft |
| D870,551 | S | 12/2019 | Klesmith |
| 10,518,951 | B2 | 12/2019 | Holley, Jr. |
| 10,543,951 | B2 | 1/2020 | Costanzo, Jr. |
| 10,543,969 | B2 | 1/2020 | Gonzalez et al. |
| D874,268 | S | 2/2020 | Muse et al. |
| D891,920 | S | 8/2020 | Sill et al. |
| 10,730,657 | B1 | 8/2020 | Spencer |
| D913,784 | S | 3/2021 | O'Donnell |
| D927,320 | S | 8/2021 | Dwork |
| 11,117,704 | B2 | 9/2021 | Chen et al. |
| 11,267,606 | B2 | 3/2022 | Garthaffner |
| D964,163 | S | 9/2022 | Chen et al. |
| 11,447,287 | B2 | 9/2022 | Chen et al. |
| 11,472,596 | B2 | 10/2022 | Chen et al. |
| D970,223 | S | 11/2022 | Huang |
| 11,505,364 | B2 | 11/2022 | Chen et al. |
| D976,697 | S | 1/2023 | Laine |
| 11,655,064 | B2 | 5/2023 | Chen et al. |
| 11,718,443 | B2 | 8/2023 | Haddad |
| D997,739 | S | 9/2023 | Chen et al. |
| D997,740 | S | 9/2023 | Chen et al. |
| D997,741 | S | 9/2023 | Chen et al. |
| D1,002,389 | S | 10/2023 | Chen et al. |
| 11,780,642 | B2 | 10/2023 | Chen et al. |
| D1,005,134 | S | 11/2023 | Chen et al. |
| D1,005,135 | S | 11/2023 | Chen et al. |
| D1,007,300 | S | 12/2023 | Chen et al. |
| 11,878,857 | B2 | 1/2024 | Chen et al. |
| D1,015,167 | S | 2/2024 | Saba |
| 11,912,475 | B2 | 2/2024 | Chen et al. |
| D1,026,667 | S | 5/2024 | Chen et al. |
| 11,975,897 | B2 | 5/2024 | Chen et al. |
| 11,993,431 | B2 | 5/2024 | Chen et al. |
| D1,031,434 | S | 6/2024 | Chen et al. |
| 2003/0213705 | A1 | 11/2003 | Woog |
| 2005/0029335 | A1 | 2/2005 | Abernathy |
| 2006/0097005 | A1 | 5/2006 | Hill et al. |
| 2007/0000980 | A1 | 1/2007 | Oliveira |
| 2008/0237320 | A1 | 10/2008 | Philips |
| 2009/0065559 | A1 | 3/2009 | Parkes |
| 2009/0134210 | A1 | 5/2009 | Li |
| 2009/0155505 | A1 | 6/2009 | Wagenheim |
| 2009/0294519 | A1 | 12/2009 | Pacheco |
| 2010/0065618 | A1 | 3/2010 | Lechevalier et al. |
| 2010/0147932 | A1 | 6/2010 | Brand |
| 2011/0198393 | A1 | 8/2011 | Bates |
| 2011/0210035 | A1 | 9/2011 | Dixon et al. |
| 2011/0290796 | A1 | 12/2011 | Burgess |
| 2012/0228173 | A1 | 9/2012 | Bostian |
| 2013/0118942 | A1 | 5/2013 | Smalley et al. |
| 2014/0166519 | A1 | 6/2014 | Alexander |
| 2014/0197230 | A1 | 7/2014 | Lopez Masague |
| 2015/0083624 | A1 | 3/2015 | Paredes et al. |
| 2015/0321832 | A1 | 11/2015 | Bankowski |
| 2016/0214760 | A1* | 7/2016 | Takeuchi ..... B65D 5/3621 |
| 2016/0229581 | A1 | 8/2016 | Smith |
| 2017/0247137 | A1 | 8/2017 | Gaidaeva et al. |
| 2018/0282039 | A1 | 10/2018 | St-laurent et al. |
| 2019/0055071 | A1 | 2/2019 | Hayter et al. |
| 2021/0139189 | A1 | 5/2021 | Chen et al. |
| 2021/0371157 | A1 | 12/2021 | Chen et al. |
| 2021/0371158 | A1 | 12/2021 | Chen et al. |
| 2021/0394951 | A1 | 12/2021 | Chen et al. |
| 2021/0394952 | A1 | 12/2021 | Chen et al. |
| 2022/0185533 | A1 | 6/2022 | Chen et al. |
| 2022/0380084 | A1 | 12/2022 | Chen et al. |
| 2023/0033698 | A1 | 2/2023 | Chen et al. |
| 2023/0249872 | A1 | 8/2023 | Chen et al. |
| 2024/0158129 | A1 | 5/2024 | Chen et al. |
| 2024/0262565 | A1 | 8/2024 | Chen et al. |

FOREIGN PATENT DOCUMENTS

| | | | |
|---|---|---|---|
| FR | 2800714 | 5/2001 | |
| FR | 2800714 A1 * | 5/2001 | ..... B65D 5/4802 |
| GB | 390356 | 4/1933 | |
| GB | 2342637 | 4/2000 | |

OTHER PUBLICATIONS

Chen, Shifeng; Non-Final Office Action for U.S. Appl. No. 16/903,440, filed Jun. 17, 2020, mailed Nov. 19, 2020, 12 pgs.
Chen, Shifeng; Notice of Allowance for U.S. Appl. No. 16/903,440, filed Jun. 17, 2020, mailed May 13, 2021, 9 pgs.
Chen, Shifeng; Requirement for Restriction/Election for U.S. Appl. No. 16/903,440, filed Jun. 17, 2020, mailed Oct. 13, 2020, 6 pgs.
Chen, Shifeng; Non-Final Office Action for U.S. Appl. No. 17/400,695, filed Aug. 12, 2021, mailed Jun. 29, 2022, 23 pgs.
Chen, Shifeng; Notice of Allowance for U.S. Appl. No. 17/400,695, filed Aug. 12, 2021, mailed Jan. 26, 2023, 14 pgs.
Chen, Shifeng; Non-Final Office Action for U.S. Appl. No. 18/134,918, filed Apr. 14, 2023, mailed Oct. 18, 2023, 28 pgs.
Chen, Shifeng; Notice of Allowance for U.S. Appl. No. 18/134,918, filed Apr. 14, 2023, mailed Dec. 22, 2023, 5 pgs.
Chen, Shifeng; Notice of Allowance for U.S. Appl. No. 17/400,711, filed Aug. 12, 2021, mailed Jul. 6, 2022, 22 pgs.
Chen, Shifeng; Certificate of Correction for U.S. Appl. No. 16/903,451, filed Jun. 17, 2020, mailed Feb. 7, 2023, 1 pg.
Chen, Shifeng; Non-Final Office Action for U.S. Appl. No. 16/903,451, filed Jun. 17, 2020, mailed Mar. 16, 2022, 35 pgs.
Chen, Shifeng; Notice of Allowance for U.S. Appl. No. 16/903,451, filed Jun. 17, 2020, mailed Jul. 20, 2022, 9 pgs.
Chen, Shifeng; Non-Final Office Action for U.S. Appl. No. 17/962,555, filed Oct. 10, 2022, mailed Mar. 8, 2023, 25 pgs.
Chen, Shifeng; Notice of Allowance for U.S. Appl. No. 17/962,555, filed Oct. 10, 2022, mailed Jul. 17, 2023, 16 pgs.
Chen, Shifeng; Non-Final Office Action for U.S. Appl. No. 16/903,460, filed Jun. 17, 2020, mailed Feb. 16, 2022, 7 pgs.
Chen, Shifeng; Non-Final Office Action for U.S. Appl. No. 16/903,460, filed Jun. 17, 2020, mailed Apr. 12, 2021, 12 pgs.
Chen, Shifeng; Notice of Allowance for U.S. Appl. No. 16/903,460, filed Jun. 17, 2020, mailed Oct. 27, 2021, 9 pgs.
Chen, Shifeng; Notice of Allowance for U.S. Appl. No. 16/903,460, filed Jun. 17, 2020, mailed May 24, 2022, 9 pgs.
Chen, Shifeng; Requirement for Restriction/Election for U.S. Appl. No. 16/903,460, filed Jun. 17, 2020, mailed Jan. 22, 2021, 5 pgs.
Chen, Shifeng; Final Office Action for U.S. Appl. No. 17/682,987, filed Feb. 28, 2022, mailed Oct. 10, 2023, 12 pgs.
Chen, Shifeng; Non-Final Office Action for U.S. Appl. No. 17/682,987, filed Feb. 28, 2022, mailed Jan. 4, 2023, 28 pgs.
Chen, Shifeng; Non-Final Office Action for U.S. Appl. No. 17/682,987, filed Feb. 28, 2022, mailed Jun. 28, 2023, 20 pgs.
Chen, Shifeng; Notice of Allowance for U.S. Appl. No. 17/682,987, filed Feb. 28, 2022, mailed Jan. 11, 2024, 14 pgs.
Chen, Shifeng; Requirement for Restriction/Election for U.S. Appl. No. 17/682,987, filed Feb. 28, 2022, mailed Nov. 2, 2022, 5 pgs.
Chen, Shifeng; Non-Final Office Action for U.S. Appl. No. 17/885,906, filed Aug. 11, 2022, mailed Jan. 10, 2023, 19 pgs.
Chen, Shifeng; Non-Final Office Action for U.S. Appl. No. 17/885,906, filed Aug. 11, 2022, mailed Jul. 11, 2023, 19 pgs.
Chen, Shifeng; Notice of Allowance for U.S. Appl. No. 17/885,906, filed Aug. 11, 2022, mailed Oct. 16, 2023, 9 pgs.
Chen, Shifeng; Notice of Allowance for Design U.S. Appl. No. 29/753,417, filed Sep. 30, 2020, mailed Mar. 22, 2023, 49 pgs.
Chen, Shifeng; Non-Final Office Action for Design U.S. Appl. No. 29/895,789, filed Jun. 26, 2023, mailed Dec. 15, 2023, 26 pgs.
Chen, Shifeng; Notice of Allowance for Design U.S. Appl. No. 29/895,789, filed Jun. 26, 2023, mailed Mar. 18, 2024, 9 pgs.

(56) References Cited

OTHER PUBLICATIONS

Chen, Shifeng; Notice of Allowance for Design U.S. Appl. No. 29/895,791, filed Jun. 26, 2023, mailed Aug. 7, 2023, 9 pgs.
Chen, Shifeng; Notice of Allowance for Design U.S. Appl. No. 29/753,409, filed Sep. 30, 2020, mailed Mar. 22, 2023, 49 pgs.
Chen, Shifeng; Notice of Allowance for U.S. Appl. No. 29/895,784, filed Jun. 26, 2023, mailed Aug. 10, 2023, 9 pgs.
Chen, Shifeng; Non-Final Office Action for Design U.S. Appl. No. 29/753,406, filed Sep. 30, 2020, mailed Mar. 27, 2023, 46 pgs.
Chen, Shifeng; Notice of Allowance for Design U.S. Appl. No. 29/753,406, filed Sep. 30, 2020, mailed Jul. 14, 2023, 11 pgs.
Chen, Shifeng; Notice of Allowance for U.S. Appl. No. 29/753,413, filed Sep. 30, 2020, mailed Mar. 22, 2023, 49 pgs.
Chen, Shifeng; Notice of Allowance for Design U.S. Appl. No. 29/895,793, filed Jun. 26, 2023, mailed Aug. 11, 2023, 9 pgs.
Chen, Shifeng; Applicant-Initiated Interview Summary for Design U.S. Appl. No. 29/753,414, filed Sep. 30, 2020, mailed Oct. 24, 2023, 2 pgs.
Chen, Shifeng; Final Office Action for Design U.S. Appl. No. 29/753,414, filed Sep. 30, 2020, mailed Aug. 30, 2023, 15 pgs.
Chen, Shifeng; Non-Final Office Action for Design U.S. Appl. No. 29/753,414, filed Sep. 30, 2020, mailed Mar. 23, 2023, 45 pgs.
Chen, Shifeng; Notice of Allowance for Design U.S. Appl. No. 29/753,414, filed Sep. 30, 2020, mailed Nov. 15, 2023, 10 pgs.
Chen, Shifeng; Certificate of Correction for U.S. Appl. No. 18/134,918, filed Apr. 14, 2023, mailed Sep. 10, 2024, 1 pg.
Chen, Shifeng; Non-Final Office Action for U.S. Appl. No. 18/612,065, filed Mar. 21, 2024, mailed Aug. 2, 2024, 25 pgs.
Chen, Shifeng; Non-Final Office Action for U.S. Appl. No. 18/412,089, filed Jan. 12, 2024, mailed Sep. 6, 2024, 33 pgs.
Chen, Shifeng; Requirement for Restriction/Election for U.S. Appl. No. 18/412,089, filed Jan. 12, 2024, mailed Jul. 30, 2024, 5 pgs.
Chen, Shifeng; Notice of Allowance for Design U.S. Appl. No. 29/904,959, filed Oct. 13, 2023, mailed Aug. 14, 2024, 38 pgs.
Chen, Shifeng; Final Office Action for U.S. Appl. No. 18/612,065, filed Mar. 21, 2024, mailed Nov. 26, 2024, 11 pgs.
Chen, Shifeng; Notice of Allowance for U.S. Appl. No. 18/612,065, filed Mar. 21, 2024, mailed Jan. 8, 2025, 12 pgs.
Chen, Shifeng; Final Office Action for U.S. Appl. No. 18/412,089, filed Jan. 12, 2024, mailed Dec. 16, 2024, 12 pgs.
Chen, Shifeng; Non-Final Office Action for U.S. Design U.S. Appl. No. 29/895,788, filed Jun. 26, 2023, mailed Dec. 4, 2024, 45 pgs.
Chen, Shifeng; Non-Final Office Action for U.S. Design Patent Application No. 29/896, 157, filed Jun. 29, 2023, mailed Jan. 27, 2025, 44 pgs.
Chen, Shifeng; Non-Final Office Action for U.S. Design U.S. Appl. No. 29/895,785, filed Jun. 26, 2023, mailed Nov. 5, 2024, 46 pgs.
Chen, Shifeng; Notice of Allowance for U.S. Appl. No. 29/904,959, filed Oct. 13, 2023, mailed Jan. 2, 2025, 13 pgs.
Chen, Shifeng; Non-Final Office Action for U.S. Appl. No. 29/916,672, filed Nov. 14, 2023, mailed Jan. 6, 2025, 41 pgs.
Chen, Shifeng; Non-Final Office Action for U.S. Appl. No. 29/896,155, filed Jun. 29, 2023, mailed Jan. 6, 2025, 43 pgs.
Chen, Shifeng; Non-Final Office Action for U.S. Appl. No. 29/895,792, filed Jun. 26, 2023, mailed Dec. 20, 2024, 45 pgs.
Chen, Shifeng; Notice of Allowance for U.S. Appl. No. 18/412,089, filed Jan. 12, 2024, mailed Feb. 26, 2025, 16 pgs.
Chen, Shifeng; Notice of Allowance for U.S. Appl. No. 29/895,788, filed Jun. 26, 2023, mailed Mar. 19, 2025, 17 pgs.
Chen, Shifeng; Final Office Action for U.S. Appl. No. 29/895,785, filed Jun. 26, 2023, mailed Feb. 18, 2025, 16 pgs.
Chen, Shifeng; Non-Final Office Action for U.S. Appl. No. 29/916,670, filed Nov. 14, 2023, mailed Feb. 14, 2025, 51 pgs.
Chen, Shifeng; Non-Final Office Action for U.S. Appl. No. 29/928,460, filed Feb. 12, 2024, mailed Mar. 18, 2025, 45 pgs.
Chen, Shifeng; Non-Final Office Action for U.S. Appl. No. 29/928,462, filed Feb. 12, 2024, mailed Mar. 18, 2025, 46 pgs.
Chen, Shifeng; Final Office Action for U.S. Appl. No. 29/916,672, filed Nov. 14, 2023, mailed Apr. 15, 2025, 15 pgs.

* cited by examiner

ONE- AND TWO-PACK BEVERAGE BOX

REFERENCE TO RELATED APPLICATION

This application is a divisional of U.S. application Ser. No. 17/682,987 filed Feb. 28, 2022, which is a continuation of U.S. application Ser. No. 16/903,460, filed Jun. 17, 2020, which issued as U.S. Pat. No. 11,472,596 on Oct. 18, 2022, each of which are hereby specifically incorporated by reference herein in their entireties.

TECHNICAL FIELD

This disclosure relates to packaging. Specifically, this disclosure relates to packaging for beverage containers.

BACKGROUND

Beverage distribution often involves the shipment of fragile or breakable vessels, such as glass bottles. Packaging utilized for beverage distribution often divides and individually protects the bottles in separate cells. These separate cells are frequently defined by additional cardboard inserts that much be manufactured as separate components from the box, assembled, and then placed into the box. This assembly process involves numerous time-consuming separate steps when performed at the volume of mass production. Alternatively, products are often placed into packaging that is not specifically intended for beverage distribution, and the box is often filled with cushioning materials to fill the extra space. This use of cushioning materials is wasteful, and the cushioning materials often are not recyclable or biodegradable.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is a box comprising: a body portion at least partially defining a cavity, the body portion defining a top body end and a bottom body end, the body portion comprising a plurality of panels, the top body end defining an opening to the cavity; a telescoping panel comprising an upper telescoping subpanel and a lower telescoping subpanel, the lower telescoping subpanel coupled to the body portion by a top hinge, the upper telescoping subpanel coupled to the lower telescoping subpanel by a telescoping hinge, the lower telescoping subpanel extending into the cavity and positioned in facing engagement with a first panel of the plurality of panels, the upper telescoping subpanel extending across the cavity from the first panel to a second panel of the plurality of panels, the second panel positioned opposite from the first panel; and a bottom portion coupled to the bottom body end by a bottom hinge, the bottom portion comprising: a bottom notch flap defining a notch; a pair of bottom side flaps folded at least partially over the bottom notch flap; and a bottom tab flap defining a locking tab, the bottom tab flap folded at least partially over each bottom side flap, the locking tab engaging the notch.

Also disclosed is a box comprising: a body portion at least partially defining a cavity, the body portion defining a top body end and a bottom body end, the top body end defining an opening to the cavity, the body portion comprising a plurality of panels; and a coupling portion coupled to the body portion by a first body hinge, the coupling portion comprising a partition panel, the partition panel partitioning the cavity into a first cell and a second cell.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures may be designated by matching reference characters for the sake of consistency and clarity.

DETAILED DESCRIPTION

Figure 1:
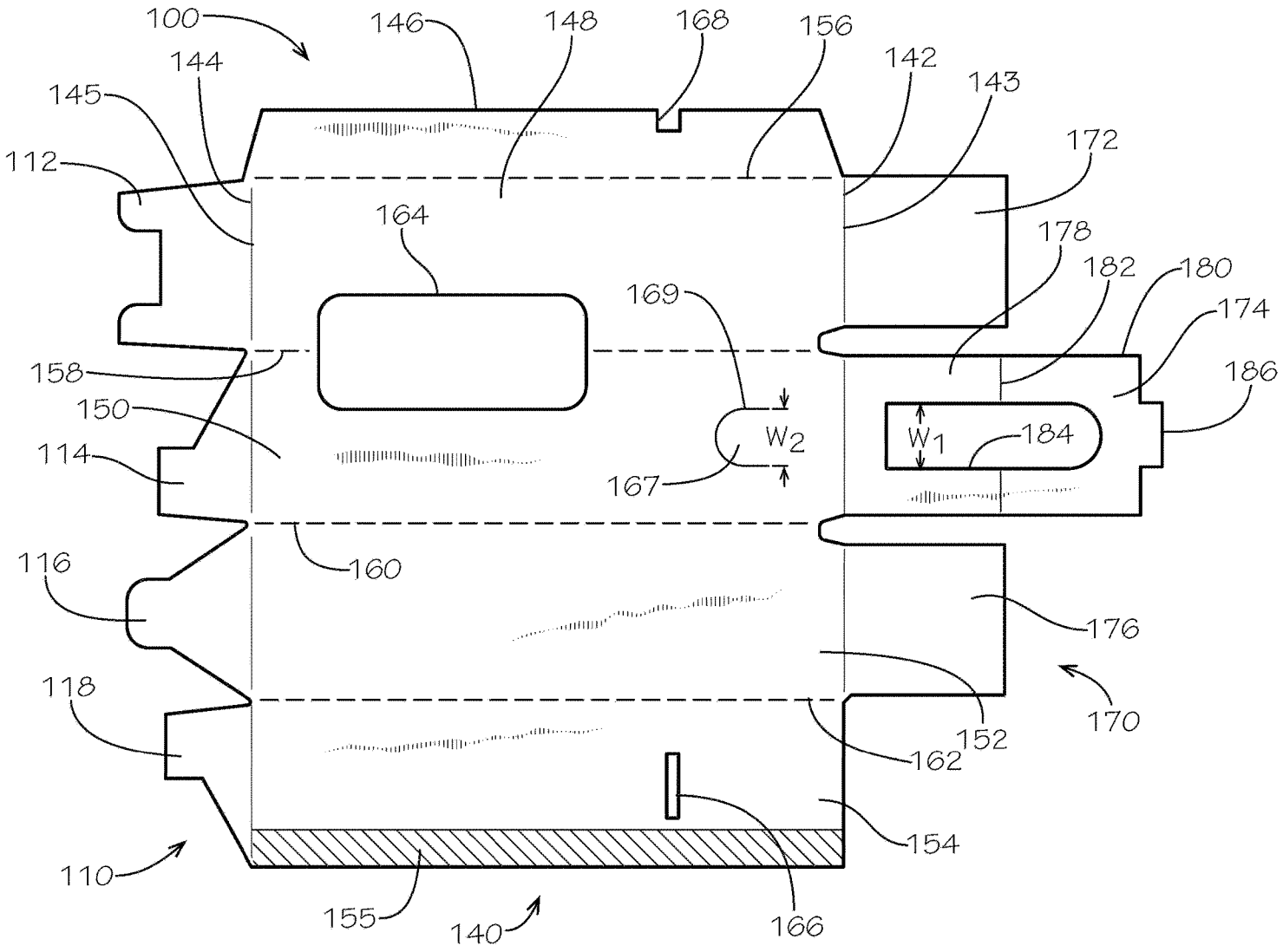
FIG. 1 is a plan view of a blank for forming a single-cell box in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a blank and associated methods, systems, devices, and various apparatus. The blank comprises a top portion, a body portion, and a bottom portion. It would be understood by one of skill in the art that the disclosed blank is described in but a few exemplary embodiments among many. No particular terminology or description should be considered limiting on the disclosure or the scope of any claims issuing therefrom.

FIG. 1 is a plan view of a blank 100 for forming a single-cell box 200 (shown in FIGS. 2-3 in a collapsed configuration, FIG. 4 in a partially erected configuration, and FIGS. 5-12 in an erected configuration) in accordance with one aspect of the present disclosure. The blank 100 can comprise a bottom portion 110, a body portion 140, and a top portion 170. The body portion 140 can define a body top end 142 and a body bottom end 144. The body top end 142 can be disposed opposite from the body bottom end 144. The top portion 170 can be coupled to the body top end 142 of the body portion 140 by a top hinge 143, and the bottom portion 110 can be coupled to the body bottom end 144 of the body portion 140 by a bottom hinge 145.

The body portion 140 can comprise a coupling panel 146, a front panel 148, a first side panel 150, a rear panel 152, and a second side panel 154. The coupling panel 146 can be coupled to the front panel 148 by a first body hinge 156. The front panel 148 can be coupled to the first side panel 150 by a second body hinge 158. The first side panel 150 can be coupled to the rear panel 152 by a third body hinge 160. The rear panel 152 can be coupled to the second side panel 154 by a fourth body hinge 162. The body hinges 156, 158, 160, 162 can extend from the body top end 142 to the body bottom end 144. The body hinges 156, 158, 160, 162 can be substantially perpendicular to the top hinge 143 and the bottom hinge 145.

The body portion 140 can define a viewing port 164. In the present aspect, the viewing port 164 can be defined by the front panel 148 and the first side panel 150, and the viewing port 164 can extend across the second body hinge 158. In other aspects, the body portion 140 can define multiple viewing ports, and the viewing ports can be defined by any one or more of the panels 146, 148, 150, 152, 154.

Figure 2:
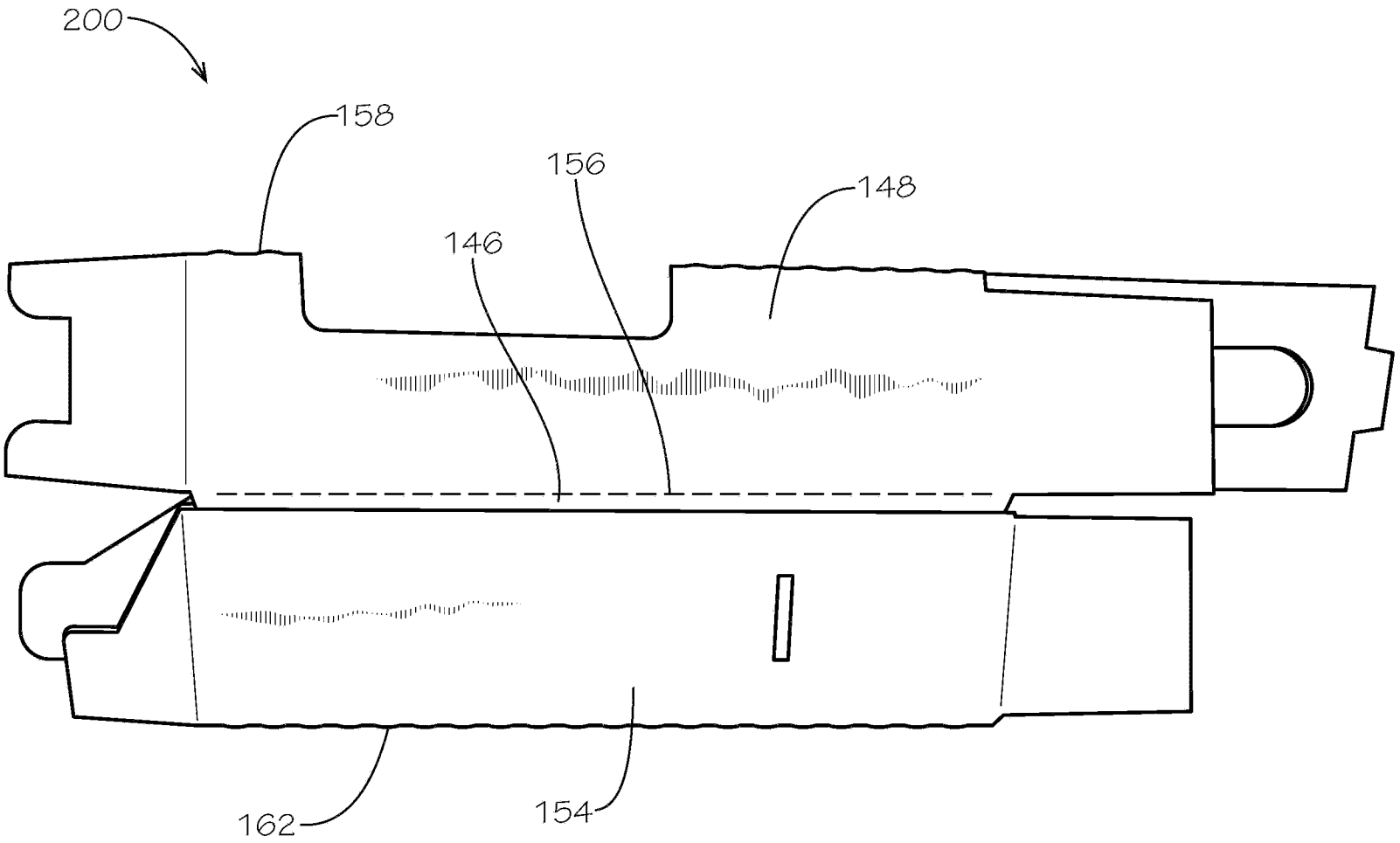
FIG. 2 is a front view of a box assembled from the blank of FIG. 1, with the box in a collapsed configuration in accordance with another aspect of the present disclosure.

The second side panel 154 can define a locking notch 166, and the coupling panel 146 can define a clearance notch 168 positioned to align in part with the locking notch 166 when the blank 100 is assembled to form the box 200 (shown in FIG. 2). The first side panel 150 can define a finger cutout 169, which can extend through the blank 100 to define a finger flap 167.

The bottom portion 110 can be a "1-2-3 bottom", also known as a "snap bottom" in the packaging industry. The bottom portion 110 can comprise a bottom notch flap 112, a first bottom side flap 114, a bottom tab flap 116, and a second bottom side flap 118. The bottom hinge 145 can couple the bottom notch flap 112 to the front panel 148, the first bottom side flap 114 to the first side panel 150, the bottom tab flap 116 to the rear panel 152, and the second bottom side flap 118 to the second side panel 154.

The top portion 170 can comprise a first top flap 172, a telescoping panel 174, and a second top flap 176. The telescoping panel 174 can comprise a lower telescoping subpanel 178 and an upper telescoping subpanel 180 coupled together by a telescoping hinge 182. The telescoping panel 174 can define a clearance slot 184, which can extend through both the lower telescoping subpanel 178 and the upper telescoping subpanel 180, as well as across the telescoping hinge 182. A width W1 of the clearance slot 184 can be sized complimentary to a width W2 of the finger flap 167. The telescoping panel 174 can define a locking tab 186 disposed opposite from the top hinge 143. The locking tab 186 can be sized to be complimentary to the locking notch 166.

The top hinge 143 can couple the first top flap 172 to the front panel 148, the telescoping panel 174 to the first side panel 150, and the second top flap 176 to the rear panel 152. Specifically, the top hinge 143 can couple the lower telescoping subpanel 178 to the first side panel 150.

The blank 100 can be assembled to form the box 200 in the collapsed configuration (shown in FIG. 2-3) by folding the blank 100 and coupling the coupling panel 146 to a coupling region 155 of the second side panel 154 (shown in diagonal lines) disposed opposite from the fourth body hinge 162. In the aspect shown in FIG. 2, the box 200 can be assembled into the collapsed configuration by folding the front panel 148 about the second body hinge 158 and folding the second side panel 154 about the fourth body hinge 162 to couple the coupling panel 146 to the second side panel 154. In other aspects, the box 200 can be assembled into the collapsed configuration by folding the blank 100 (shown in FIG. 1) in half about the third body hinge 160 (shown in FIG. 1), folding the coupling panel 146 about the first body hinge 156, and coupling the coupling panel 146 to the second side panel 154.

Figure 3:
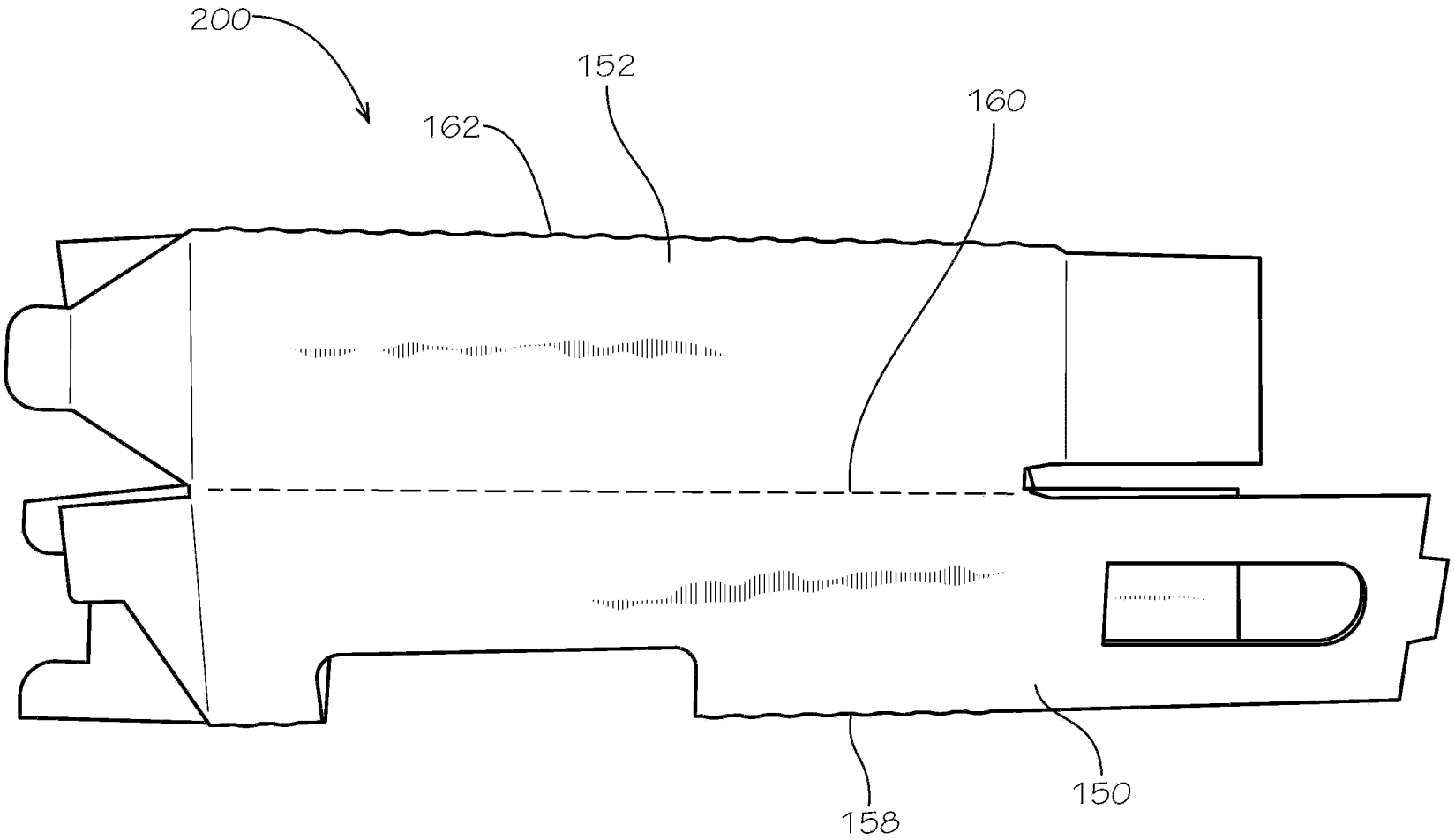
FIG. 3 is a rear view of the box of FIG. 2 in the collapsed configuration.

FIG. 2 is a front view of the box 200 assembled from the blank 100 of FIG. 1, with the box 200 shown in the collapsed configuration. FIG. 3 is a rear view of the box 200 of FIG. 2, shown in the collapsed configuration. As shown in FIG. 2, the coupling panel 146 can be coupled to the second side panel 154, such as with an adhesive or a mechanical fastener, such as staples, rivets, or any other suitable means, for example and without limitation. In the collapsed configuration, the box 200 can be folded about two of the four body hinges 156, 158, 160, 162 (third body hinge 160 shown in FIG. 3) so that two pairs of adjacent panels 148, 150, 152, 154 are positioned in facing contact with one another. For example, in the present aspect, the second body hinge 158 can be folded to position the front panel 148 in facing engagement with the first side panel 150 (shown in FIG. 3), and the fourth body hinge 162 can be folded to position the second side panel 154 in facing engagement with the rear panel 152 (shown in FIG. 3). In this aspect, the first body hinge 156 and the third body hinge 160 can be substantially unfolded.

In other aspects, the first body hinge 156 can be folded to position the front panel 148 in facing engagement with either or both of the coupling panel 146 and the second side panel 154, and the third body hinge 160 can be folded to position the first side panel 150 in facing engagement with the rear panel 152. In such aspects, the second body hinge 158 and the fourth body hinge 162 can be substantially unfolded.

In other words, in the collapsed configuration, every-other body hinge is folded. For example, the odd body hinges (first body hinge 156 and third body hinge 160) can be folded while the even body hinges (second body hinge 158 and fourth body hinge 162) can be unfolded, or vice versa.

Figure 4:
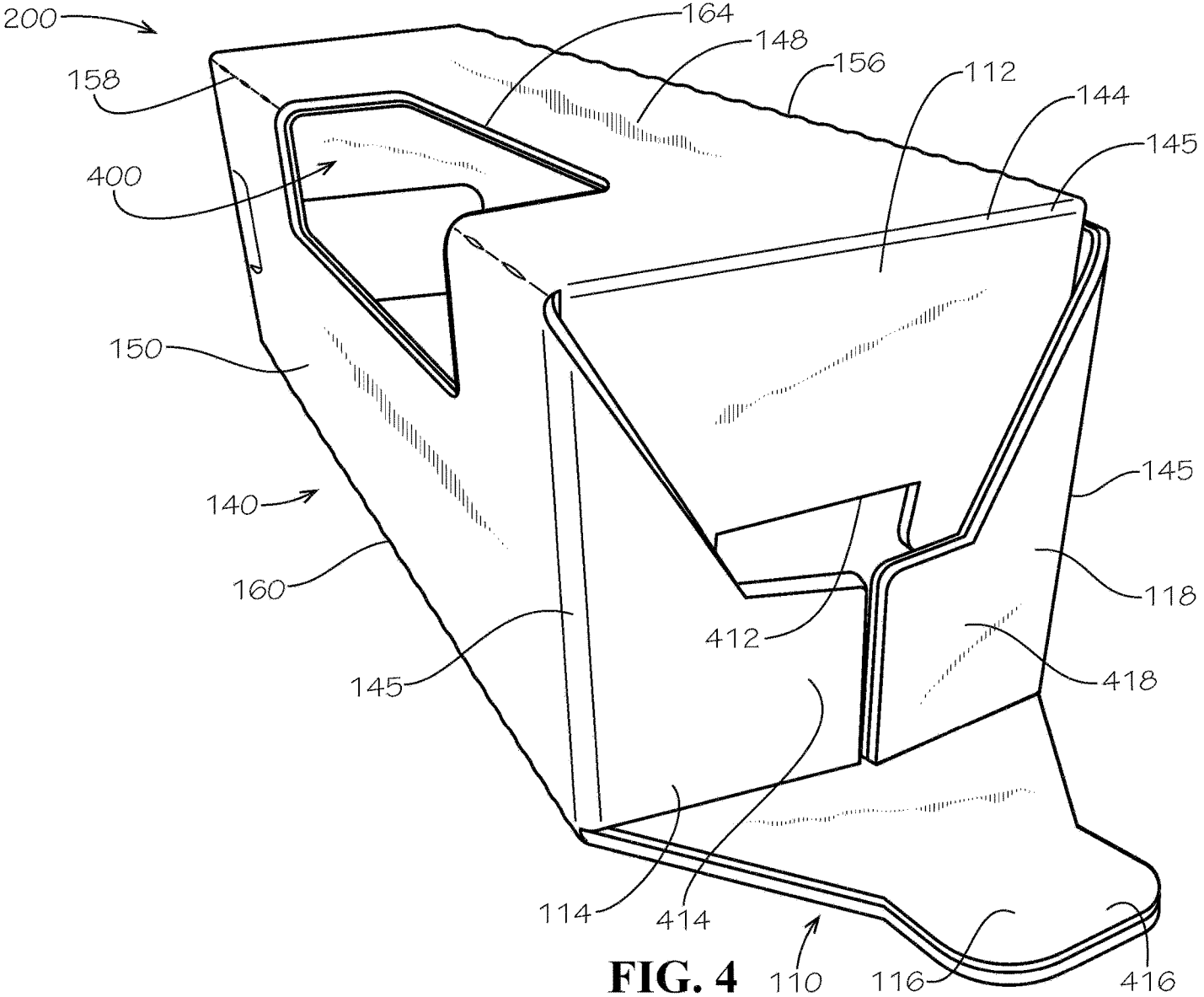
FIG. 4 is a perspective bottom view of the box of FIG. 2 in a partially erected configuration.
Figure 5:
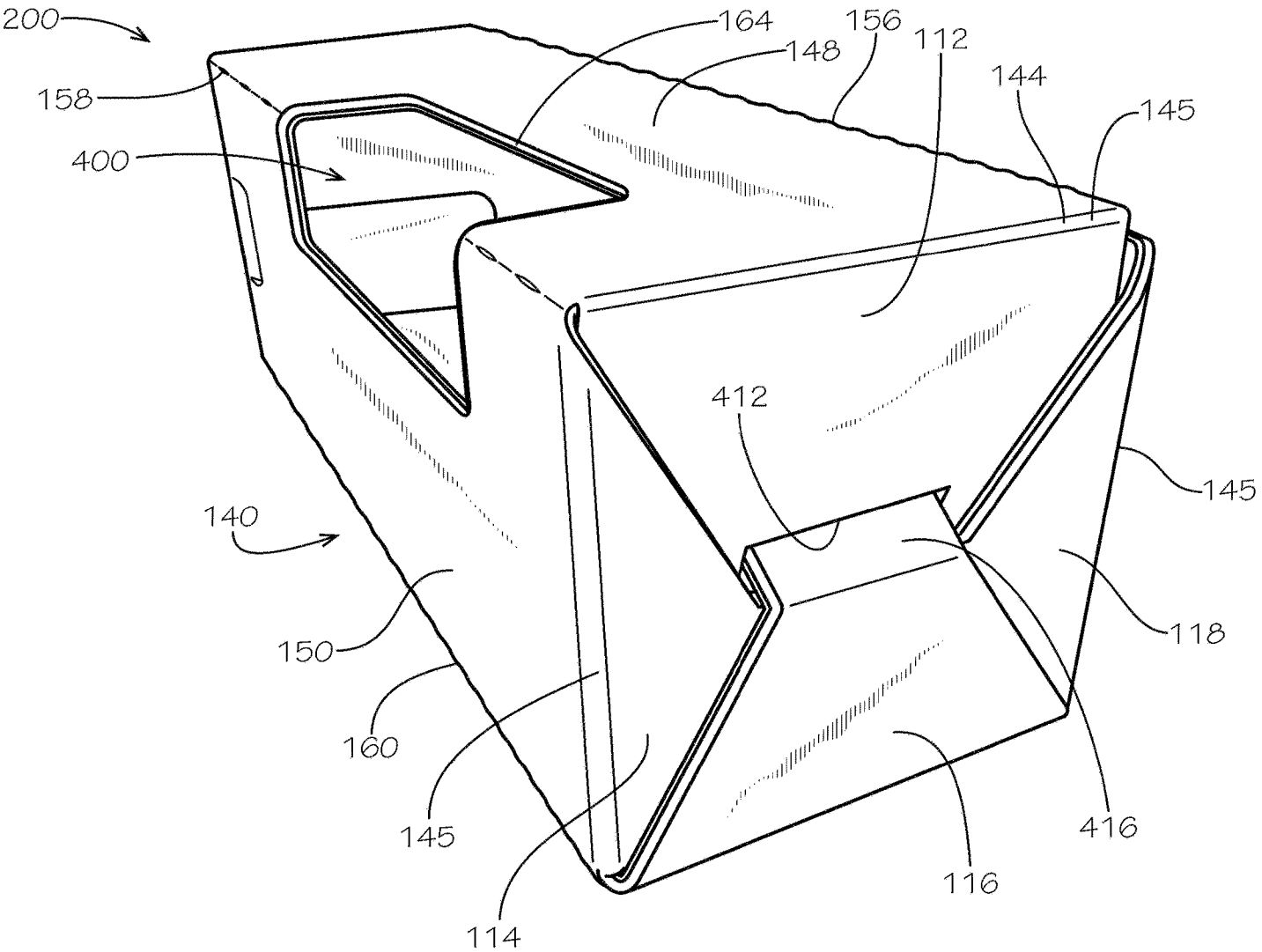
FIG. 5 is a perspective bottom view of the box of FIG. 2 in an erected configuration.

FIG. 4 is a perspective bottom view of the box 200 of FIG. 2 in the partially erected configuration, and FIG. 5 is a perspective bottom view of the box 200 of FIG. 2 in the erected configuration. FIGS. 4 and 5 demonstrate the erection of the box 200 to the erected configuration shown in FIGS. 5-12.

To place the box 200 in the partially erected configuration shown, the body hinges 156, 158, 160, 162 (fourth body hinge 162 shown in FIG. 1) can first be folded to approximately 90-degree angles so that the front panel 148 and the rear panel 152 (shown in FIG. 1) are substantially perpendicular to the side panels 150, 154 and the coupling panel 146 (second side panel 154 and coupling panel 146 shown in FIG. 1). Doing so can form a cavity 400 within the box 200, as shown through the viewing port 164.

Next, the bottom portion 110 can be folded to enclose the body bottom end 144 of the body portion 140 to partially enclose the cavity 400. First, the bottom notch flap 112 can be folded relative to the front panel 148 and towards the rear panel 152 about the bottom hinge 145. Then, the bottom side flaps 114, 118 can be folded towards one another about the bottom hinge 145 and positioned over the bottom notch flap 112. Each bottom side flap 114, 118 can define a side tab 414, 418 that can partially cover a notch 412 defined by the bottom notch flap 112. The notch can be configured to receive a locking tab 416 defined by the bottom tab flap 116. As shown in FIG. 5, the bottom tab flap 116 can be folded about the bottom hinge 145 over the side tabs 414, 418

(shown in FIG. 4), and the locking tab 416 can be slipped into the notch 412 under the bottom notch flap 112. Once the locking tab 416 is inserted into the notch 412, the box 200 can be secured in the erected configuration.

Figure 6:
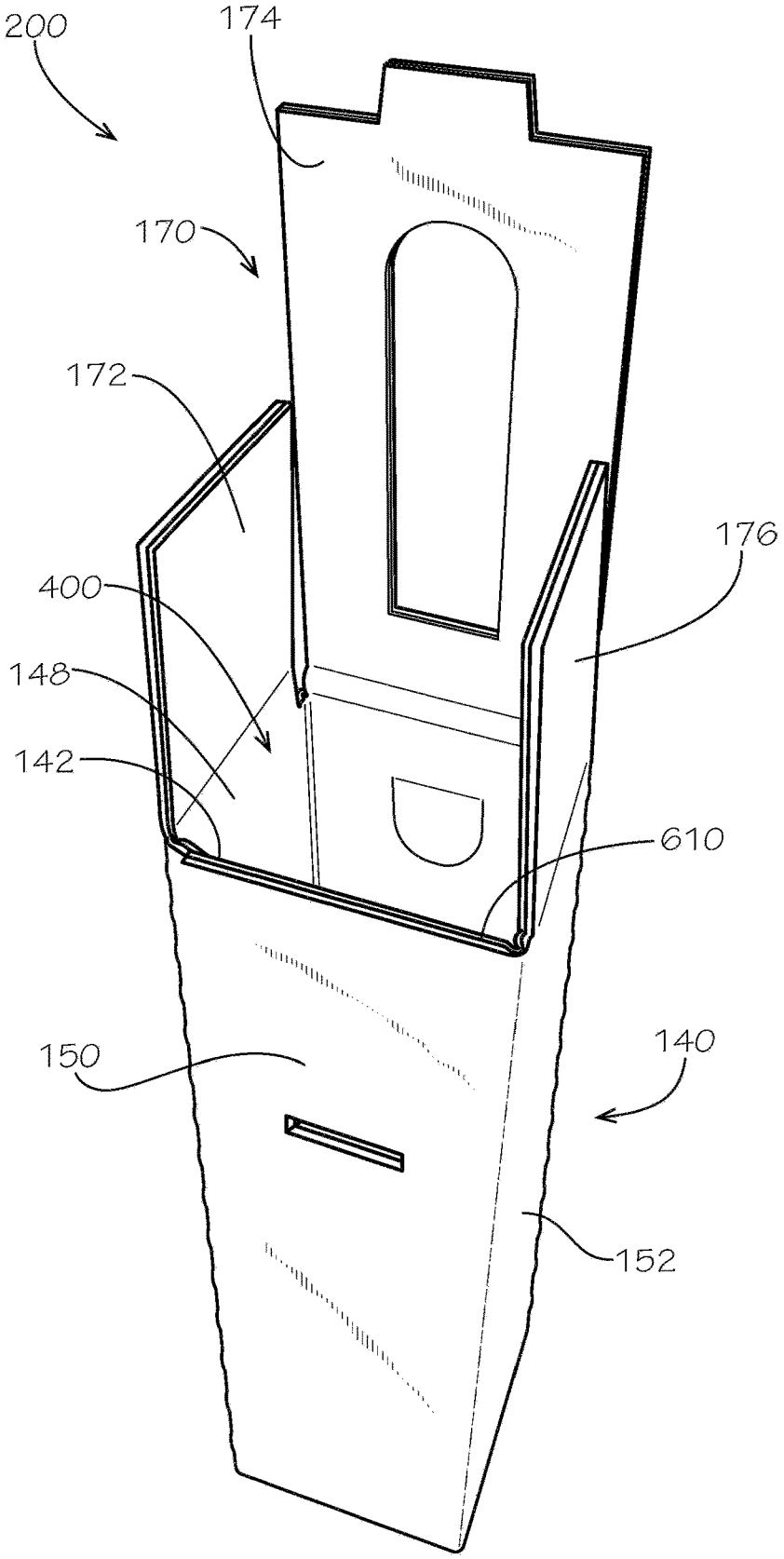
FIG. 6 is a rear view of the box of FIG. 2 in the erected configuration with a top portion of the box in an open configuration.
Figure 7:
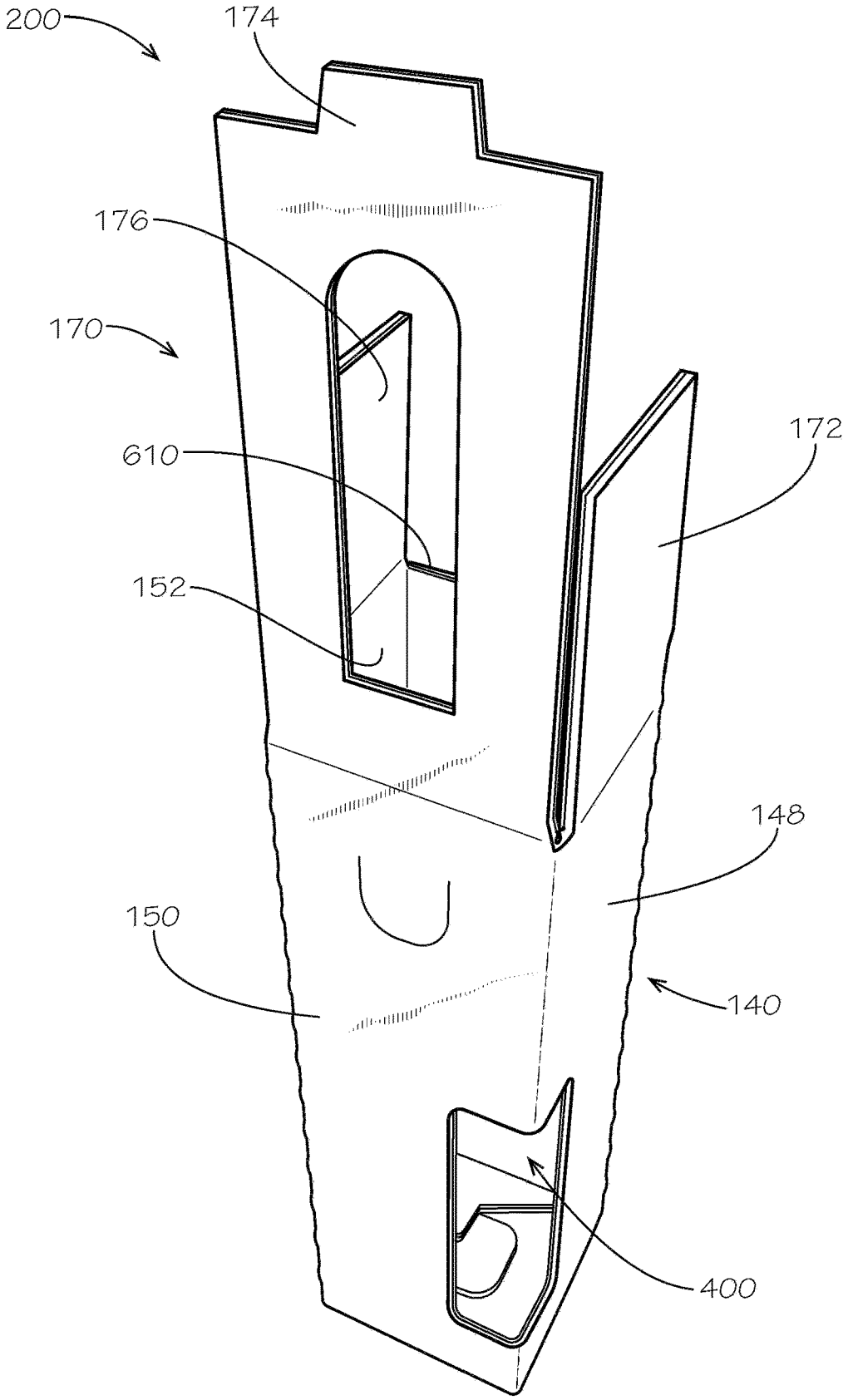
FIG. 7 is a front view of the box of FIG. 2 in the erected configuration with the top portion in the open configuration.

FIG. 6 is a rear view of the box 200 of FIG. 2 in the erected configuration with the top portion 170 in an open configuration. FIG. 7 is a front view of the box 200 of FIG. 2 in the erected configuration with the top portion 170 in the open configuration. The body top end 142 of the body portion 140 can define an opening 610 to the cavity 400. In the open configuration, the first top flap 172, the telescoping panel 174, and the second top flap 176 can be positioned so that they do not obstruct the opening 610, and the telescoping panel 174 can be positioned external to the cavity 400. For example, the top flaps 172, 176 can be aligned and parallel with the respective front and rear panels 148, 152. The telescoping panel 174 can be aligned and parallel with the first side panel 150. In other aspects, the flaps 172, 174, 176 can be folded outwards from the opening 610 in the open configuration, as demonstrated by top flaps 172, 176 in FIG. 11.

Figure 8:
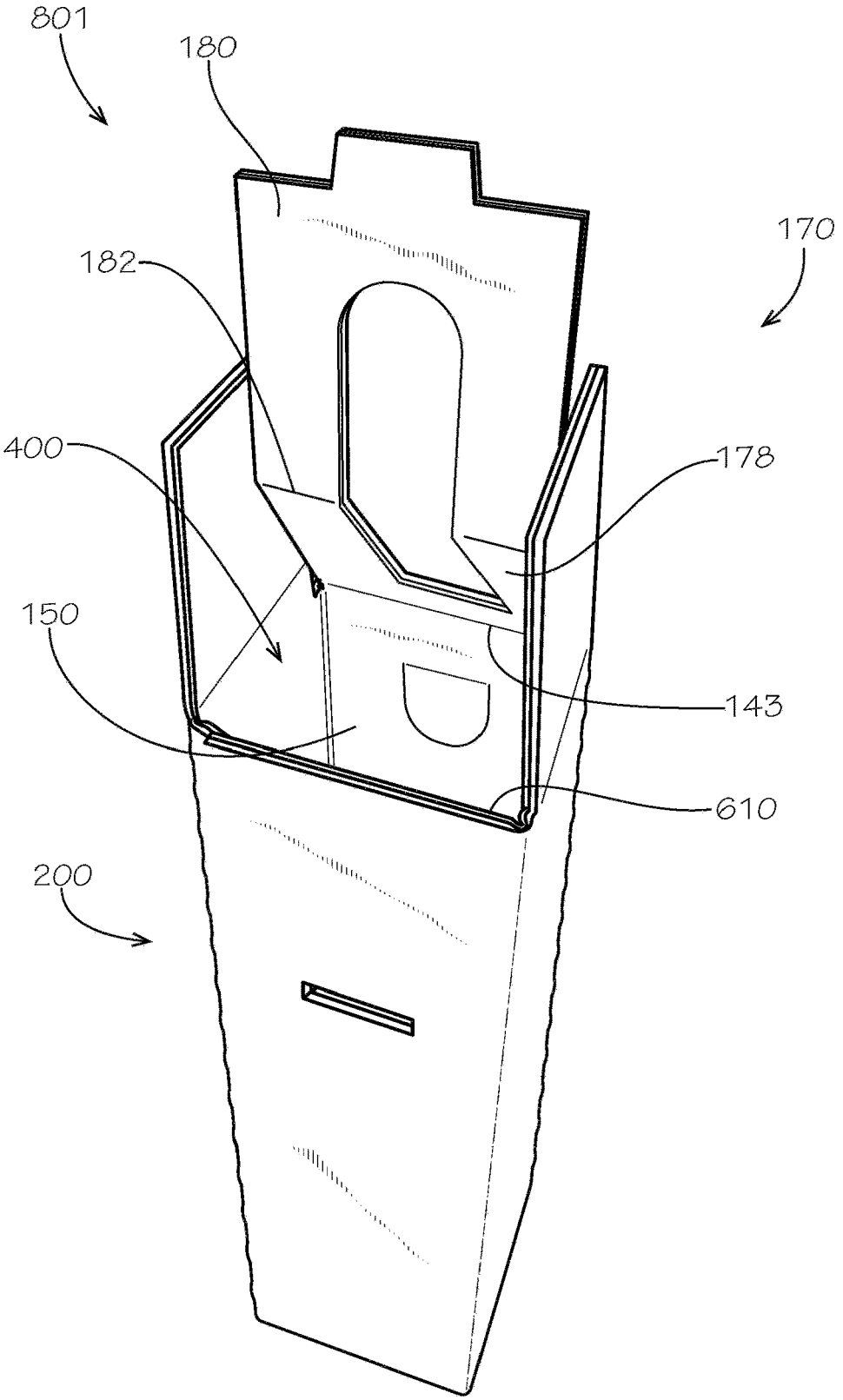
FIG. 8 is a perspective rear view of the box of FIG. 2 demonstrating a first step in reconfiguring the top portion from the open configuration to a closed configuration.
Figure 9:
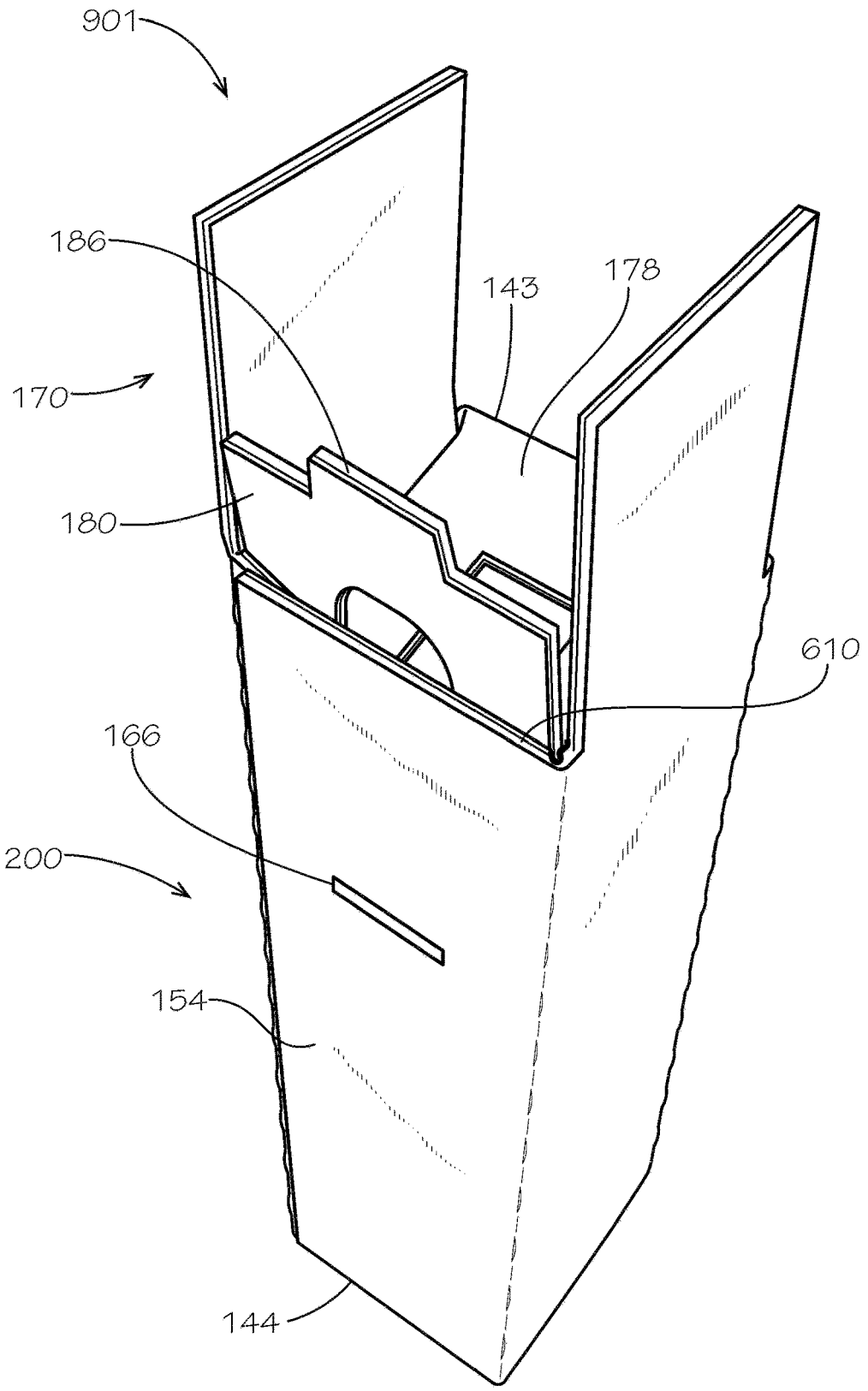
FIG. 9 is a perspective rear view of the box of FIG. 2 demonstrating a second step in reconfiguring the top portion from the open configuration to the closed configuration.
Figure 10:
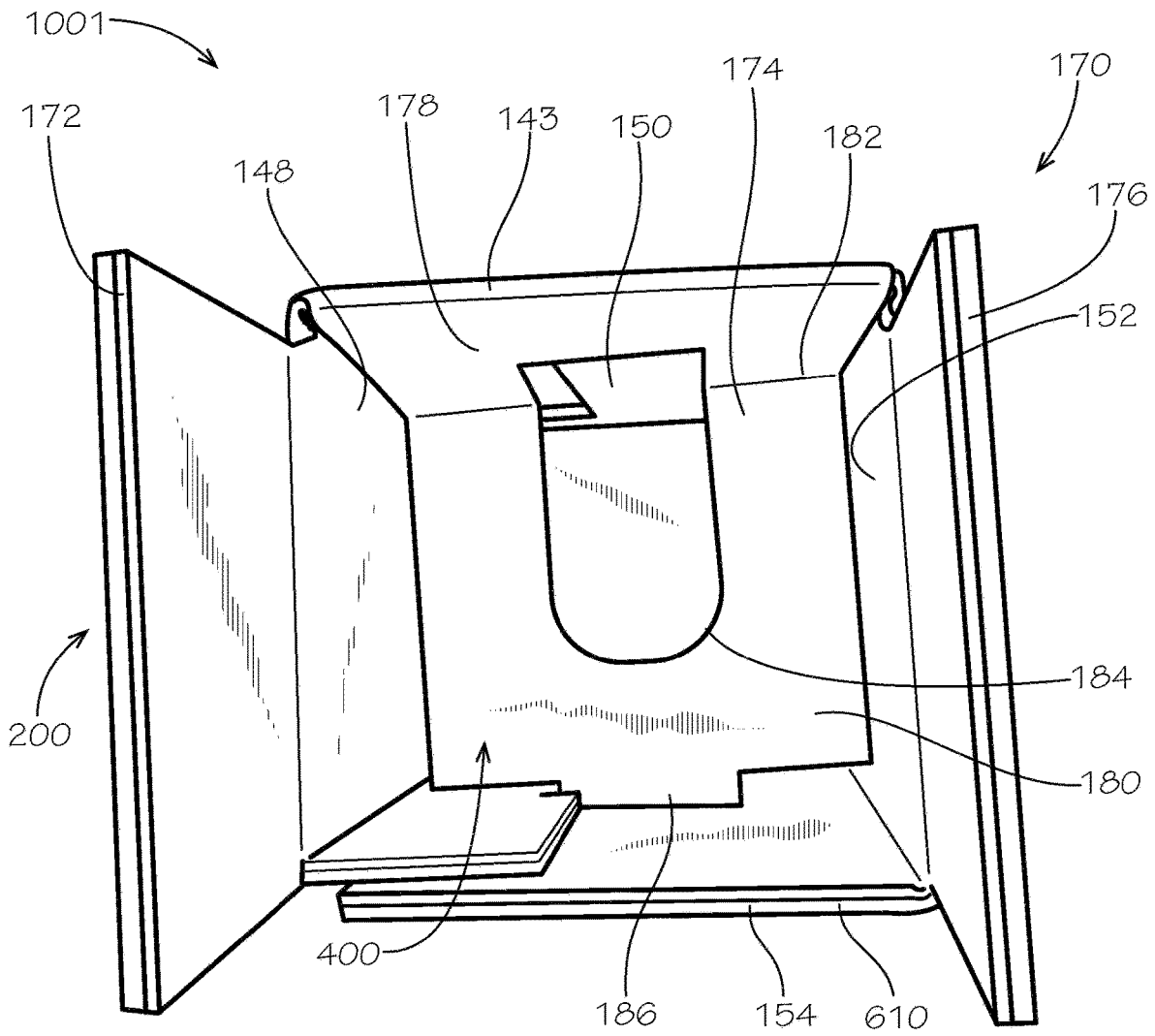
FIG. 10 is a top view of the box of FIG. 2 demonstrating a third step in reconfiguring the top portion from the open configuration to the closed configuration.
Figure 11:
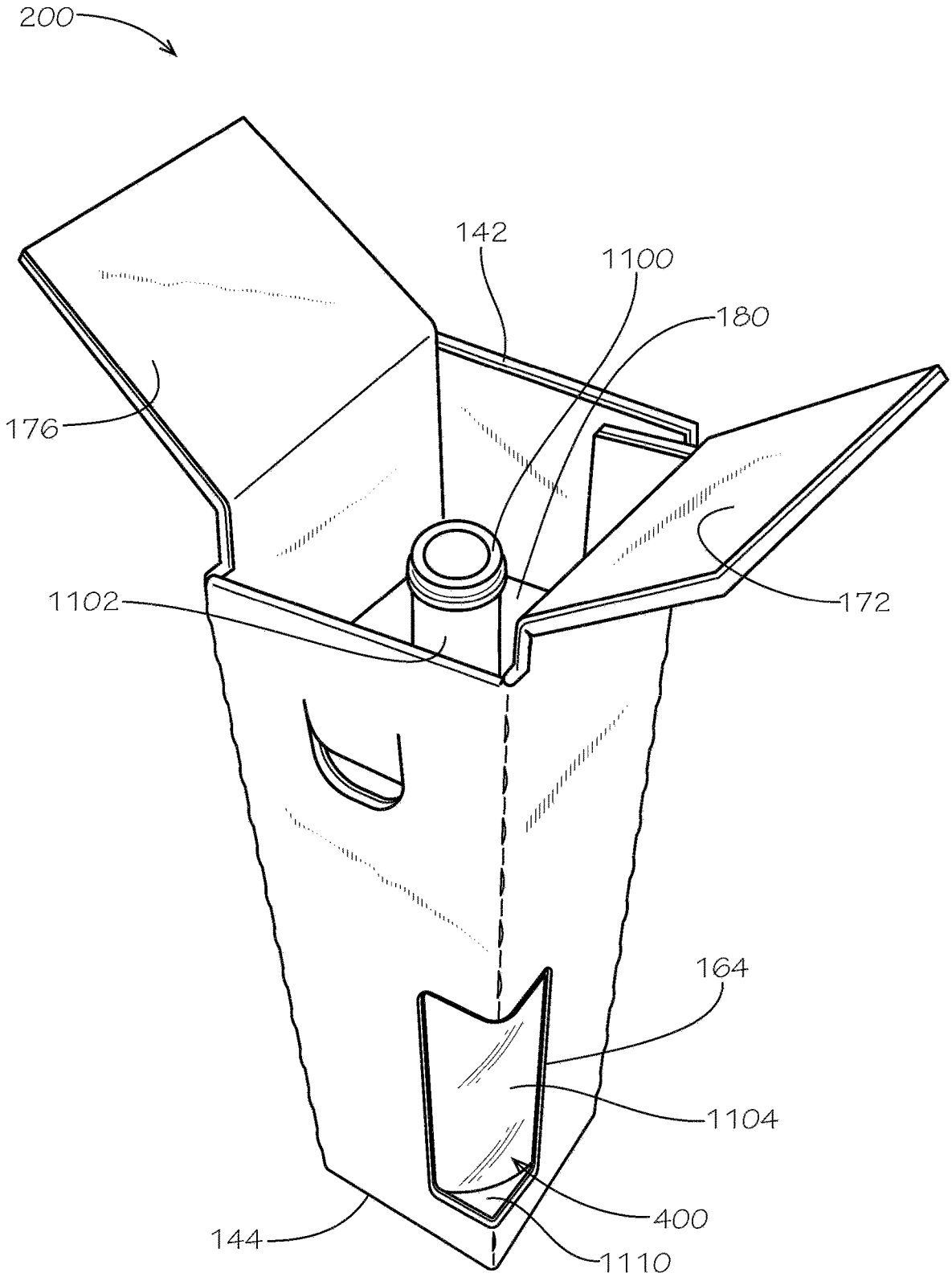
FIG. 11 is a perspective front view of the box of FIG. 2 with a container enclosed in a cavity of the box.
Figure 12:
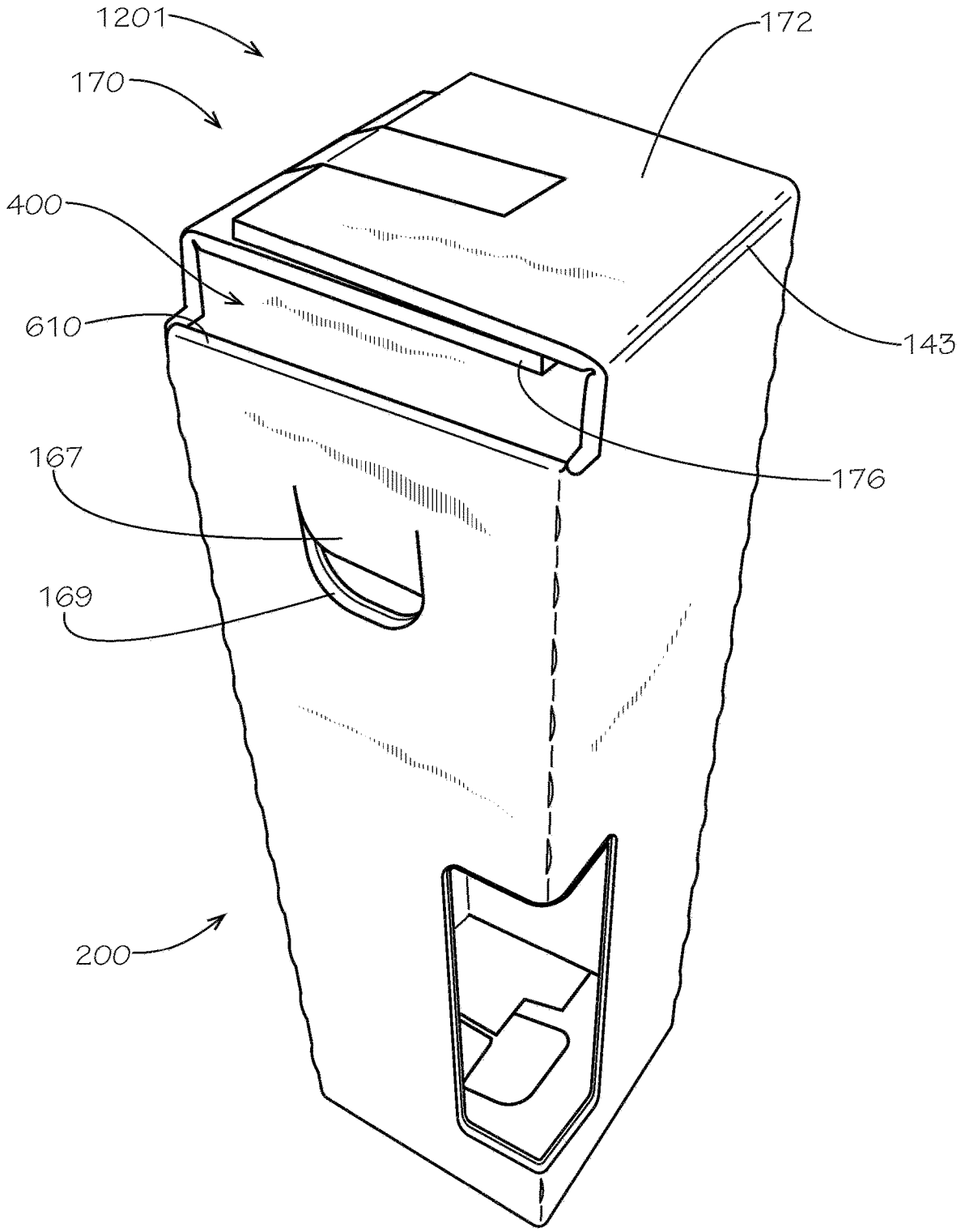
FIG. 12 is a perspective front view of the box of FIG. 2 demonstrating the final step in reconfiguring the top portion to the closed position.

FIGS. 8-12 demonstrate a process for reconfiguring the top portion 170 from the open configuration show in FIGS. 6 and 7 to a closed configuration shown in FIG. 12. FIG. 8 is a perspective rear view of the box 200 of FIG. 2 demonstrating a first step 801 in reconfiguring the top portion 170 from the open configuration to the closed configuration. FIG. 9 is a perspective rear view of the box 200 of FIG. 2 demonstrating a second step 901 in reconfiguring the top portion 170 from the open configuration to the closed configuration. FIG. 10 is a top view of the box 200 of FIG. 2 demonstrating a third step 1001 in reconfiguring the top portion 170 from the open configuration to the closed configuration. FIG. 11 is a perspective front view of the box 200 of FIG. 2 demonstrating how a container 1100 can be enclosed in the cavity 400 of the box 200. FIG. 12 is a perspective front view of the box 200 of FIG. 2 demonstrating the final step 1201 in reconfiguring the top portion 170 to the closed position.

In step 801, the lower telescoping subpanel 178 can be folded downwards about the top hinge 143 towards the opening 610 to the cavity 400 while the upper telescoping subpanel 180 can be folded upwards about the telescoping hinge 182 and away from the opening 610.

In step 901, the lower telescoping subpanel 178 can be folded through the opening 610 and into the cavity 400 (shown in FIG. 8) about the top hinge 143. The upper telescoping subpanel 180 can be positioned partially below the opening 610, while the locking tab 186 can be positioned external to the cavity 400 (shown in FIG. 8).

As demonstrated between FIGS. 9 and 10, in step 1001, the telescoping panel 174 can be fully folded about the top hinge 143 into the cavity 400 through the opening 610. As the telescoping panel 174 is folded inwards, the locking tab 186 can slide down the second side panel 154 until it engages the locking notch 166 (shown in FIG. 9). In this manner, the telescoping panel 174 can telescope from the open configuration outside of the cavity 400 to the closed configuration wherein the telescoping panel 174 is positioned within the cavity 400, and the telescoping panel 174 can at least partially enclose a portion of the cavity 400 between the upper telescoping subpanel 180 and the body bottom end 144 (shown in FIG. 9). As shown, the telescoping panel 174 of the top portion 170 can be in the closed position while the top flaps 172, 176 of the top portion 170 can remain in the open configuration.

In the closed configuration, the lower telescoping subpanel 178 can be positioned in facing engagement with the first side panel 150, substantially parallel to the side panels 150, 154 and substantially perpendicular to the front panel 148 and the rear panel 152. The lower telescoping subpanel 178 can be folded approximately 180-degrees about the top hinge 143. The upper telescoping subpanel 180 can be folded about the telescoping hinge 182 relative to the lower telescoping subpanel 178 so that the upper telescoping subpanel 180 can extend from the first side panel 150 to the second side panel 154 in the closed configuration. In the aspect shown, the upper telescoping subpanel 180 can be positioned substantially perpendicular to the lower telescoping subpanel 178, as well as the side panels 150, 154, the front panel 148, and the rear panel 152. The telescoping hinge 182 can be folded approximately 90-degrees. In other aspects, the telescoping hinge 182 can be folded more or less than 90-degrees, and an acute or obtuse angle can be formed between the upper telescoping subpanel 180 and the lower telescoping subpanel 178.

Engagement between the locking tab 186 and the locking notch 166 can resist reconfiguration of the telescoping panel 174 back towards the open configuration if an upward force is applied to the upper telescoping subpanel 180. This can be desirable, as demonstrated by FIG. 11, when the box 200 contains the container 1100. In the present aspect, the cavity 400 can define one cell 1110 shaped to receive the container 1100. In the aspect shown, the container 1100 can be a bottle, such as a wine bottle for example and without limitation. In other aspects, the container 1100 can be a different type of container. For example and without limitation, the container can be a bottle or can of any alcoholic or non-alcoholic beverages, including beer, liquor, wine, soda, water, juice, or any other beverage. In other aspects, the container can hold different materials, such as foods, chemicals, perfumes, or any other material. In the present aspect, the box 200 can be ideally suited for holding a container 1100 with an elongated and narrowed neck, as commonly found in bottles for liquor, wine, beer, olive oil, vinegar, syrups, and cocktail mixers, for example and without limitation.

The container 1100 can define a reduced neck 1102 and a barrel 1104. The reduced neck 1102 can extend through a portion of the clearance slot 184 (shown in FIG. 10) defined by the upper telescoping subpanel 180. The reduced neck 1102 can be positioned between the upper telescoping subpanel 180 and the body top end 142, and the barrel 1104 can be positioned between the upper telescoping subpanel 180 and the body bottom end 144. Interference between the container 1100 and the upper telescoping subpanel 180 can prevent upwards and downwards motion of the container 1100 within the cavity 400. This can be desirable where the box 200 is used for shipping the container 1100, for example and without limitation. The barrel 1104 of the container 1100 can be viewed through the viewing port 164, such as to identify the contents of the container 1100.

In FIG. 12, the box 200 is shown with the top portion 170 in the closed configuration. Step 1201 can comprise folding the top flaps 172, 176 inwards about the top hinge 143 towards one another to at least partially cover the opening 610. With the top flaps 172, 176 folded inwards and overlapping one another, the top flaps 172, 176 can be in the closed configuration. The finger flap 167 can be folded inwards from the finger cutout 169 and into the cavity 400 to permit a user to insert one or more fingers to aid in carrying the box 200. In doing so, the finger flap 167 can pass through a portion of the clearance slot 184 (shown in FIG. 10) defined by the lower telescoping subpanel 178 (shown in FIG. 10).

Figure 13:
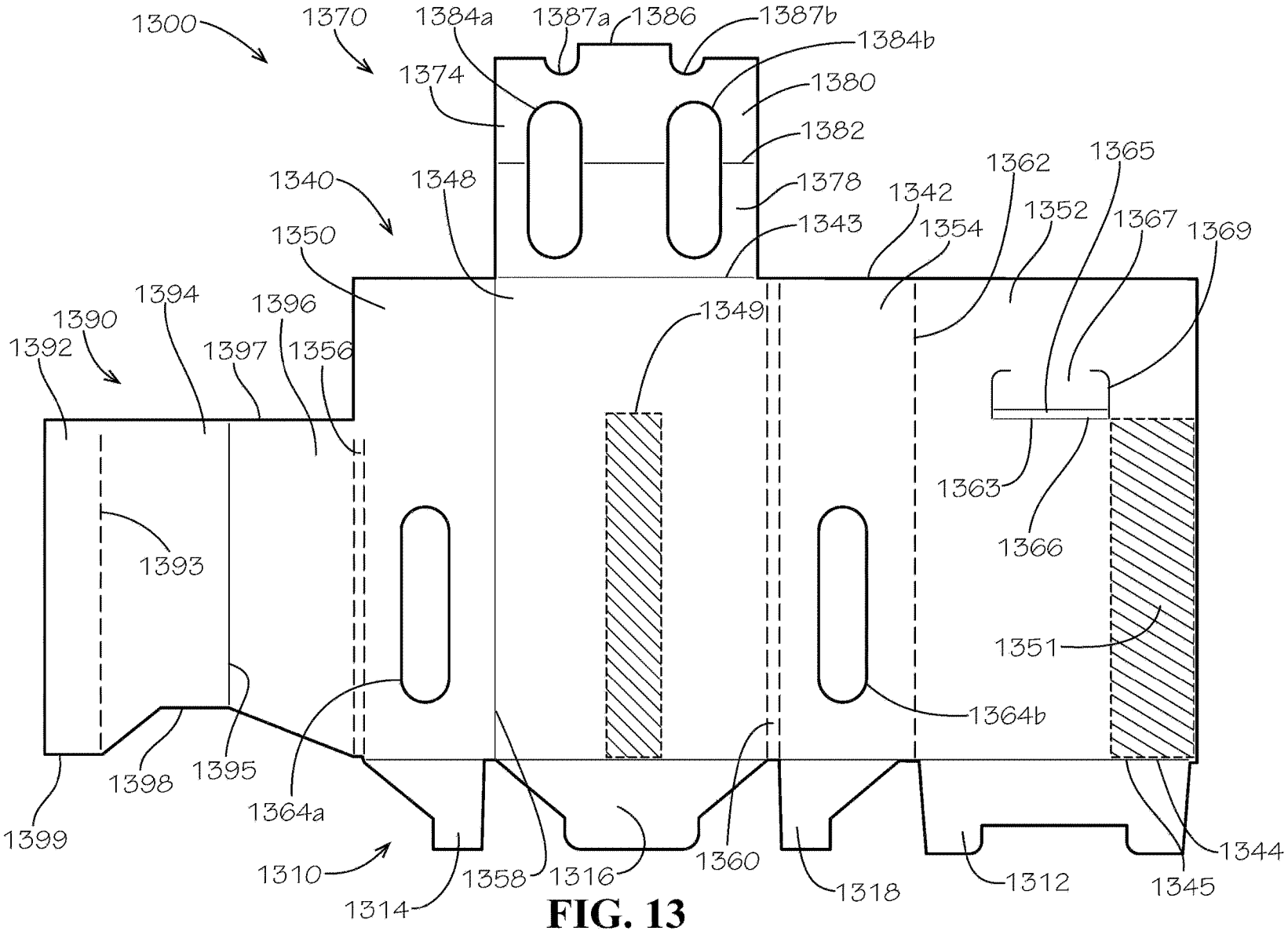
FIG. 13 is a plan view of a blank for forming a two-cell box in accordance with another aspect of the present disclosure.

FIG. 13 is a plan view of a blank 1300 for forming a two-cell box 1400 (shown in FIGS. 14-15 in a collapsed configuration, FIGS. 16-17 in partially erected configurations, and FIGS. 18-24 in an erected configuration) in accordance with one aspect of the present disclosure. The blank 1300 can comprise a bottom portion 1310, a body portion 1340, a top portion 1370, and a coupling portion 1390. The body portion 1340 can define a body top end 1342 and a body bottom end 1344. The body top end 1342 can be disposed opposite from the body bottom end 1344. The top portion 1370 can be coupled to the body top end 1342 of the body portion 1340 by a top hinge 1343, and the bottom portion 1310 can be coupled to the body bottom end 1344 of the body portion 1340 by a bottom hinge 1345.

The body portion 1340 can comprise a front panel 1348, a first side panel 1350, a rear panel 1352, and a second side panel 1354. The coupling portion 1390 can be coupled to the first side panel 1350 by a first body hinge 1356. The first side panel 1350 can be coupled to the front panel 1348 by a second body hinge 1358. The front panel 1348 can be coupled to the second side panel 1354 by a third body hinge 1360. The second side panel 1354 can be coupled to the rear panel 1352 by a fourth body hinge 1362. The body hinges 1356, 1358, 1360, 1362 can extend from the body top end 1342 to the body bottom end 1344. The body hinges 1356, 1358, 1360, 1362 can be substantially perpendicular to the top hinge 1343 and the bottom hinge 1345.

The body portion 1340 can define a pair of viewing ports 1364*a,b*. In the present aspect, the viewing ports 1364*a,b* can be defined by the first side panel 1350 and the second side panel 1354, respectively. In other aspects, the viewing ports 1364*a,b* can be defined by one or more different panels. For example, the viewing ports 1364*a,b* can be defined by the front panel 1348 and/or the rear panel 1352. In some aspects, the body portion 1340 can define more than two viewing ports 1364. For example, the front panel 1348 can define viewing ports 1364 than can be aligned with viewing ports 1364*a,b* defined by the side panels 1350, 1354 or the rear panel 1352. In other aspects, the viewing ports 1364*a,b* can each be defined by multiple panels 1348, 1350, 1352, 1354 and can extend across one or more body hinges 1356, 1358, 1360, 1362, as demonstrated by the viewing port 164 of blank 100 shown in FIG. 1.

In the present aspect, the rear panel 1352 can define a locking notch cut 1366, which can extend through the blank 1300 and completely around a locking notch knock out 1365. The locking notch cut 1366 can be defined adjacent to a finger cutout 1369, which can extend through the blank 1300 to define a finger flap 1367.

The coupling portion 1390 can comprise a first coupling panel 1392, a partition panel 1394, and a second coupling panel 1396. The first coupling panel 1392 can be coupled to the partition panel 1394 by a first coupling hinge 1393. The partition panel 1394 can be coupled to the second coupling panel 1396 by a second coupling hinge 1395. The second coupling panel 1396 can be coupled to the first side panel 1350 of the body portion 1340 by the first body hinge 1356.

The coupling portion 1390 can define a coupling portion top end 1397 and a coupling portion bottom end 1399. The coupling portion top end 1397 can be disposed opposite from the coupling portion bottom end 1399. The coupling portion 1390 can define a clearance cut 1398 extending into the coupling portion bottom end 1399 upwards and towards the coupling portion top end 1397. The clearance cut 1398 can extend into the partition panel 1394 and the second coupling panel 1396. The first coupling hinge 1393 can extend from the coupling portion top end 1397 to the coupling portion bottom end 1399. The second coupling hinge 1395 can extend from the coupling portion top end 1397 to the clearance cut 1398. The coupling portion bottom end 1399 can be aligned with or positioned above the body bottom end 1344. The coupling portion top end 1397 can be positioned below the body top end 1342. In the present aspect, the coupling portion top end 1397 can be aligned with or just below a bottom edge 1363 of the locking notch cut 1366.

The bottom portion 1310 can be a "1-2-3 bottom", also known as a "snap bottom". The bottom portion 1310 can comprise a bottom notch flap 1312, a first bottom side flap 1314, a bottom tab flap 1316, and a second bottom side flap 1318. The bottom hinge 1345 can couple the bottom notch flap 1312 to the rear panel 1352, the first bottom side flap 1314 to the first side panel 1350, the bottom tab flap 1316 to the front panel 1348, and the second bottom side flap 1318 to the second side panel 1354.

In the present aspect, the top portion 1370 can comprise a telescoping panel 1374. The telescoping panel 1374 can comprise a lower telescoping subpanel 1378 and an upper telescoping subpanel 1380 coupled together by a telescoping hinge 1382. The telescoping panel 1374 can define a pair of clearance slots 1384*a,b*, which can extend through both the lower telescoping subpanel 1378 and the upper telescoping subpanel 1380, as well as across the telescoping hinge 1382. The telescoping panel 1374 can define a locking tab 1386 disposed opposite from the top hinge 1343. The locking tab 1386 can be sized to be complimentary to the locking notch cut 1366. The locking tab 1386 can be positioned between a pair of clearance cuts 1387*a,b*, defined by the telescoping panel 1374 opposite from the top hinge 1343. The top hinge 1343 can couple the telescoping panel 1374 to the front panel 1348. Specifically, the top hinge 1343 can couple the lower telescoping subpanel 1378 to the front panel 1348. In some aspects, the top portion 1370 can also comprise top flaps coupled to the side panels 1350, 1354, similar to the top flaps 172, 176 of the blank 100 in FIG. 1.

The blank 1300 can be assembled to form the box 1400 in the collapsed configuration (shown in FIGS. 14-15) by folding the blank 1300 and coupling the second coupling panel 1396 to a coupling region 1351 of the rear panel 1352 (denoted by diagonal lines) and the first coupling panel 1392 to a coupling region 1349 of the front panel 1348 (denoted by diagonal lines). This can be accomplished by first folding the coupling portion 1390 about the first body hinge 1356, then coupling the first coupling panel 1392 to the coupling region 1349 of the front panel 1348, then folding the body portion 1340 in half about the third body hinge 1360, and finally coupling the coupling region 1351 of the rear panel 1352 to the second coupling panel 1396. Coupling of the coupling panels 1392, 1396 to the respective coupling regions 1349, 1351 can be accomplished through use of an adhesive, or through a mechanical method, such as stapling, engagement between hook-and-loop fasteners, or riveting, or any other suitable method.

Figure 14:
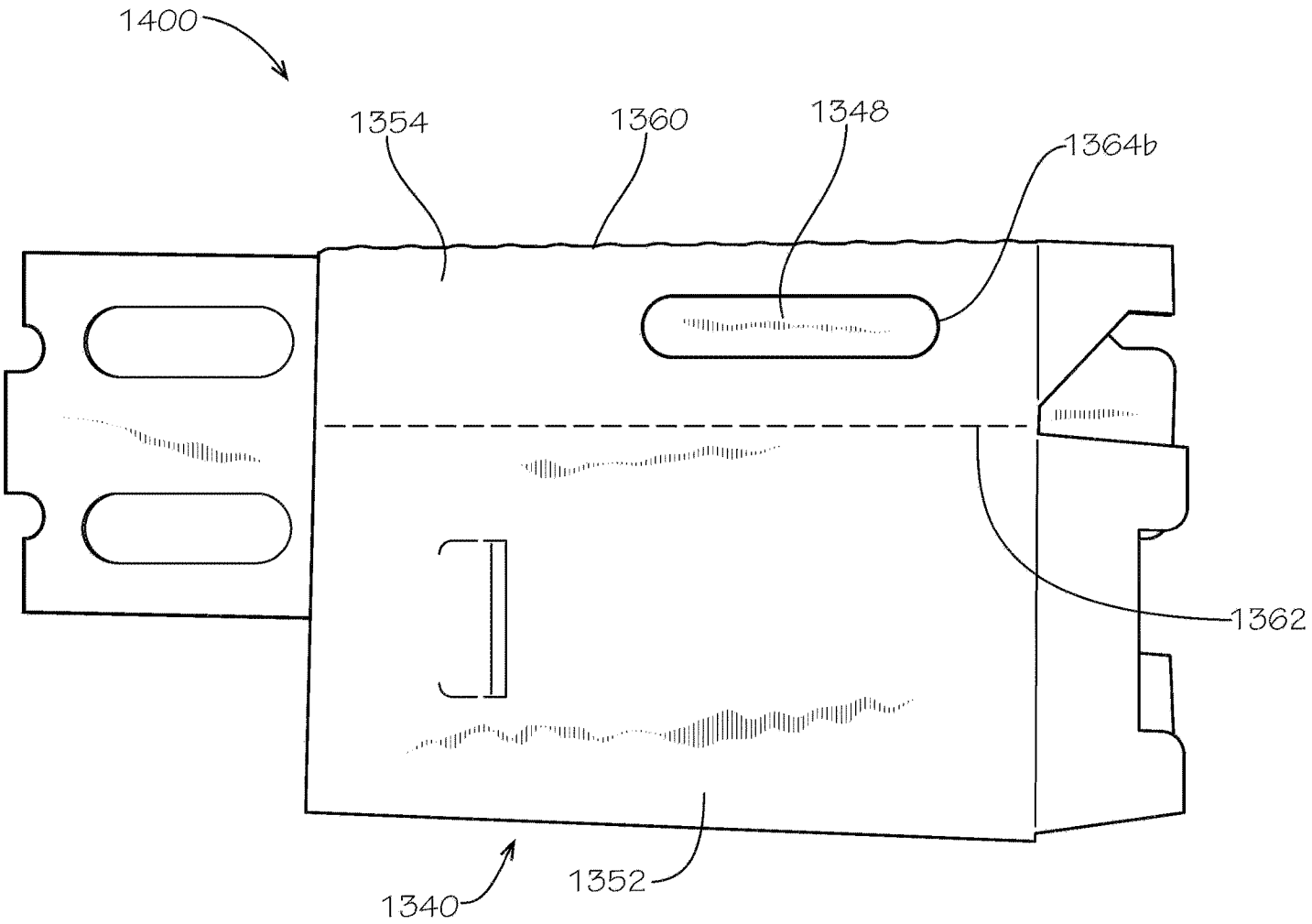
FIG. 14 is a rear view of a box assembled from the blank of FIG. 13 in a collapsed configuration in accordance with another aspect of the present disclosure.
Figure 15:
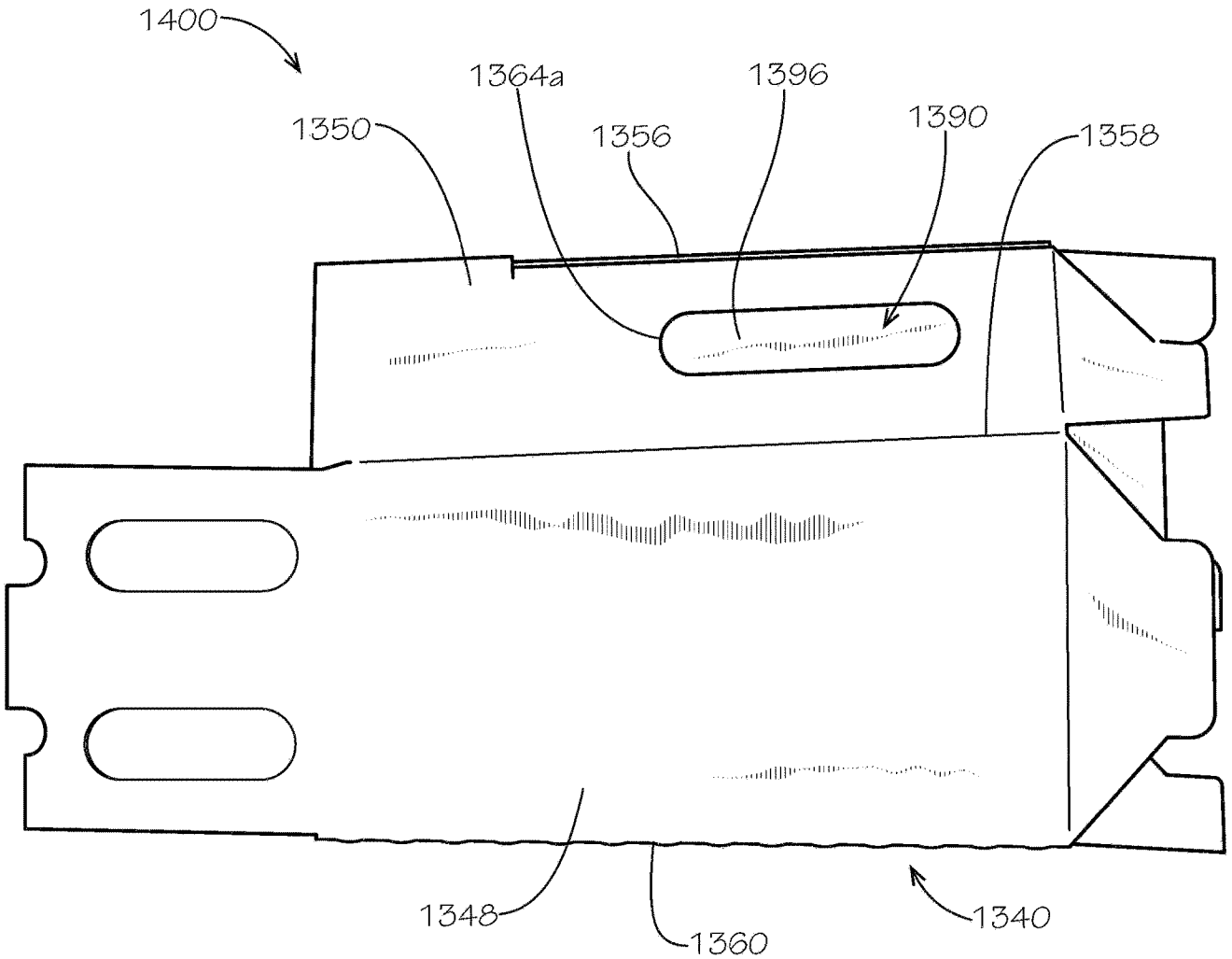
FIG. 15 is a front view of the box of FIG. 14 in the collapsed configuration.

FIG. 14 is a rear view of the box 1400 assembled from the blank 1300 of FIG. 13, with the box 1400 shown in the collapsed configuration. FIG. 15 is a front view of the box 1400 assembled from the blank 1300 of FIG. 13, with the box shown in the collapsed configuration. Referring to both FIGS. 14 and 15, in the collapsed configuration, the body portion 1340 can be folded in half about the third body hinge 1360 so that the coupling portion 1390 is positioned between the halves (one half comprising panels 1348, 1350 and the other half comprising panels 1352, 1354). FIG. 15 demonstrates this arrangement by showing the second coupling panel 1396 of the coupling portion 1390 through viewing port 1364*a*. Whereas the first body hinge 1356 and the third body hinge 1360 can be folded approximately 180-degress, the second body hinge 1358 and the fourth body hinge 1362 can be substantially unfolded.

Accordingly, the front panel 1348 can be aligned with the first side panel 1350, the rear panel 1352 can be aligned with the second side panel 1354, and the first coupling panel 1392 (shown in FIG. 13), the partition panel 1394 (shown in FIG. 13), and the second coupling panel 1396 can be aligned with one another in the collapsed configuration. The rear panel 1352 can be positioned in facing engagement with at least the second coupling panel 1396 and the partition panel 1394 of the coupling portion 1390, and the front panel 1348 can be positioned in facing engagement with at least the first coupling panel 1392 and the partition panel 1394 of the coupling portion 1390 in the collapsed configuration.

Figure 16:
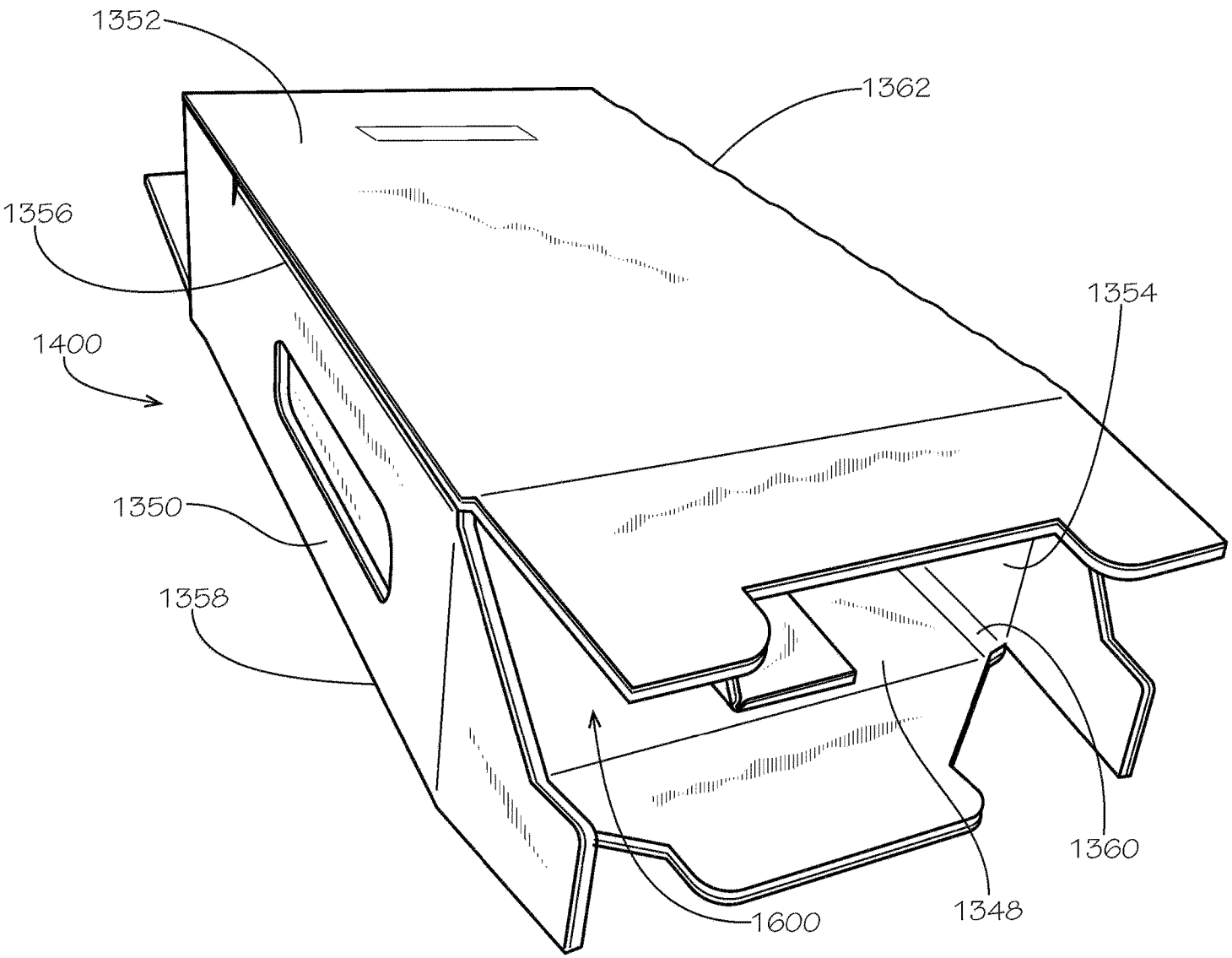
FIG. 16 is a perspective bottom view of the box of FIG. 14 in a partially erected configuration.
Figure 17:
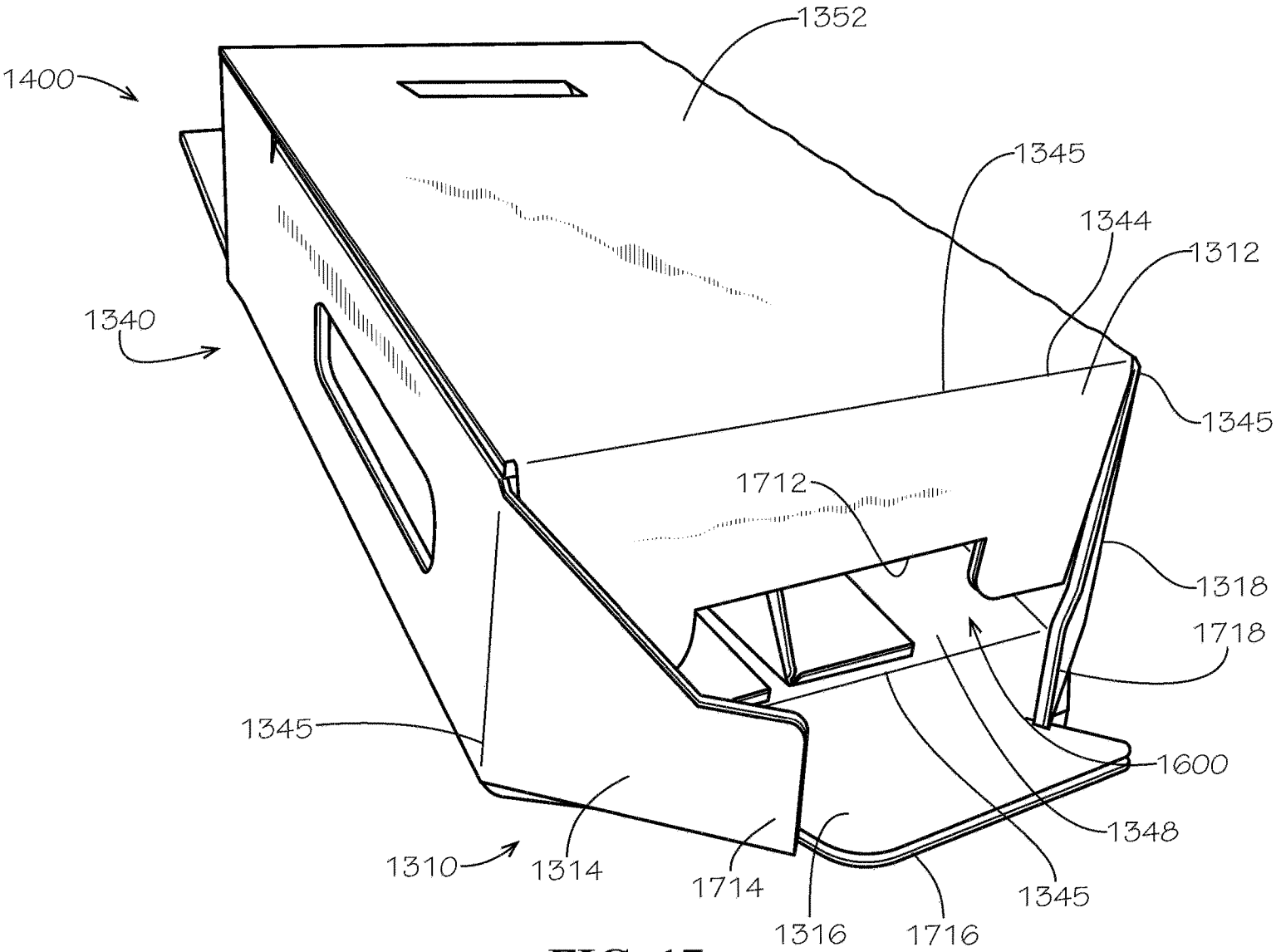
FIG. 17 is a perspective bottom view of the box of FIG. 14 in another partially erected configuration.
Figure 18:
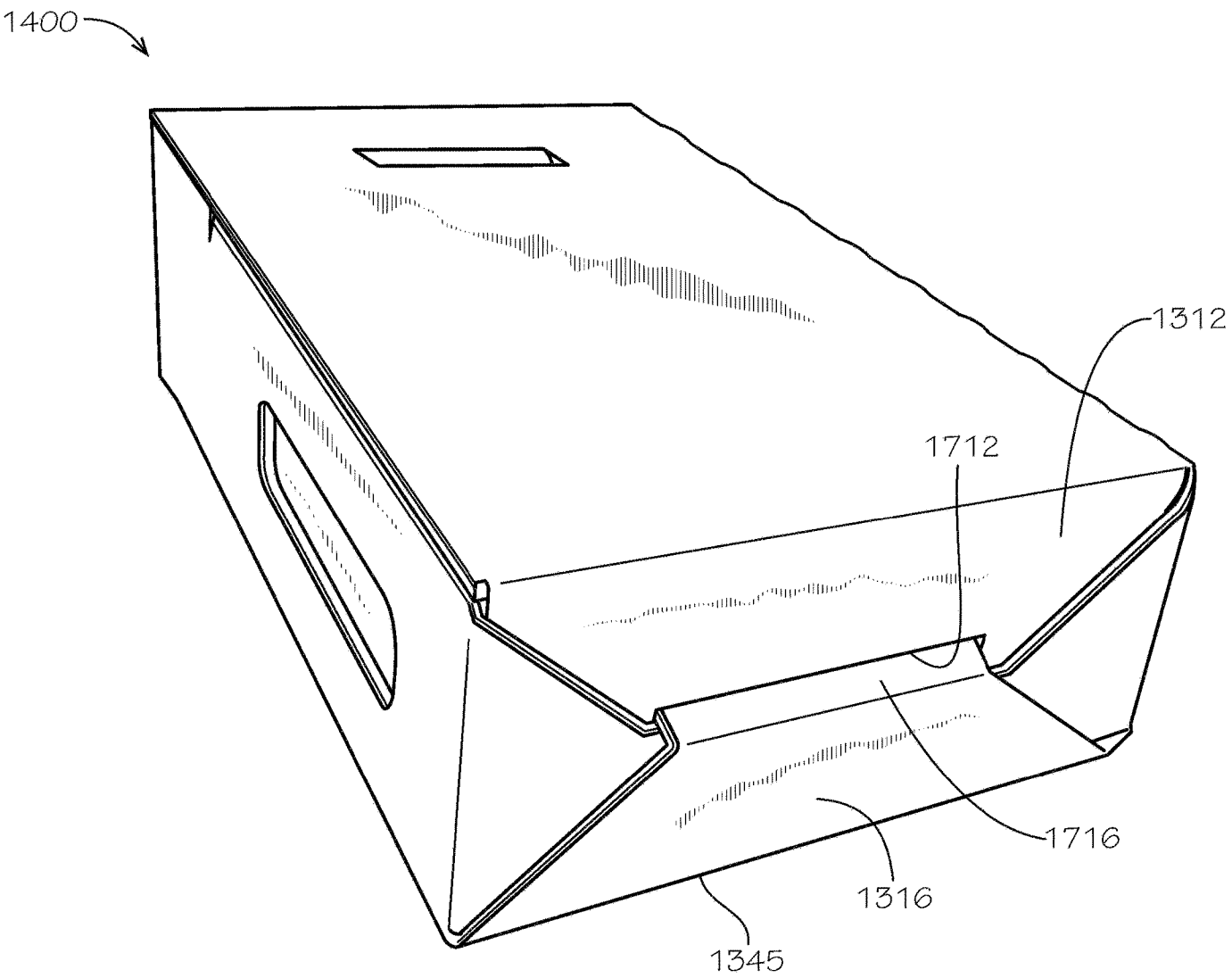
FIG. 18 is a perspective bottom view of the box of FIG. 14 in an erected configuration.

FIG. 16 is a perspective bottom view of the box 1400 of FIG. 14 in a partially erected configuration. FIG. 17 is a perspective bottom view of the box 1400 of FIG. 14 in another partially erected configuration. FIG. 18 is a perspective bottom view of the box 1400 of FIG. 14 in the erected configuration. FIGS. 16-18 demonstrate the erection of the box 1400 to the erected configuration shown in FIGS. 18-24, which can be similar to the method demonstrated in FIGS. 4 and 5 for box 200 of FIG. 2.

To place the box 1400 in the partially erected configuration shown in FIG. 16, the body hinges 1356, 1358, 1360, 1362 can be folded to approximately 90-degree angles so that the front panel 1348 and the rear panel 1352 can be positioned substantially perpendicular to side panels 1350, 1354. Doing so can form a cavity 1600 within the box 1400.

Next, referring to FIG. 17, the bottom portion 1310 can be folded to enclose the body bottom end 1344 of the body portion 1340, thereby partially enclosing the cavity 1600. First, the bottom notch flap 1312 can be folded relative to the rear panel 1352 about the bottom hinge 1345 towards the front panel 1348, as shown in FIG. 17. Then, the bottom side flaps 1314, 1318 can be folded towards one another about the bottom hinge 1345 and positioned over the bottom notch flap 1312. Each bottom side flap 1314, 1318 can define a side tab 1714, 1718 that can partially cover a notch 1712 defined by the bottom notch flap 1312. The notch 1712 can be configured to receive a locking tab 1716 defined by the bottom tab flap 1316. As shown in FIG. 18, the bottom tab flap 1316 can be folded about the bottom hinge 1345 over the side tabs 1714, 1718 (shown in FIG. 17), and the locking tab 1716 can be slipped into the notch 1712 under the bottom notch flap 1312. Once the locking tab 1716 is inserted into the notch 1712, the box 1400 can be secured in the erected configuration.

Figure 19:
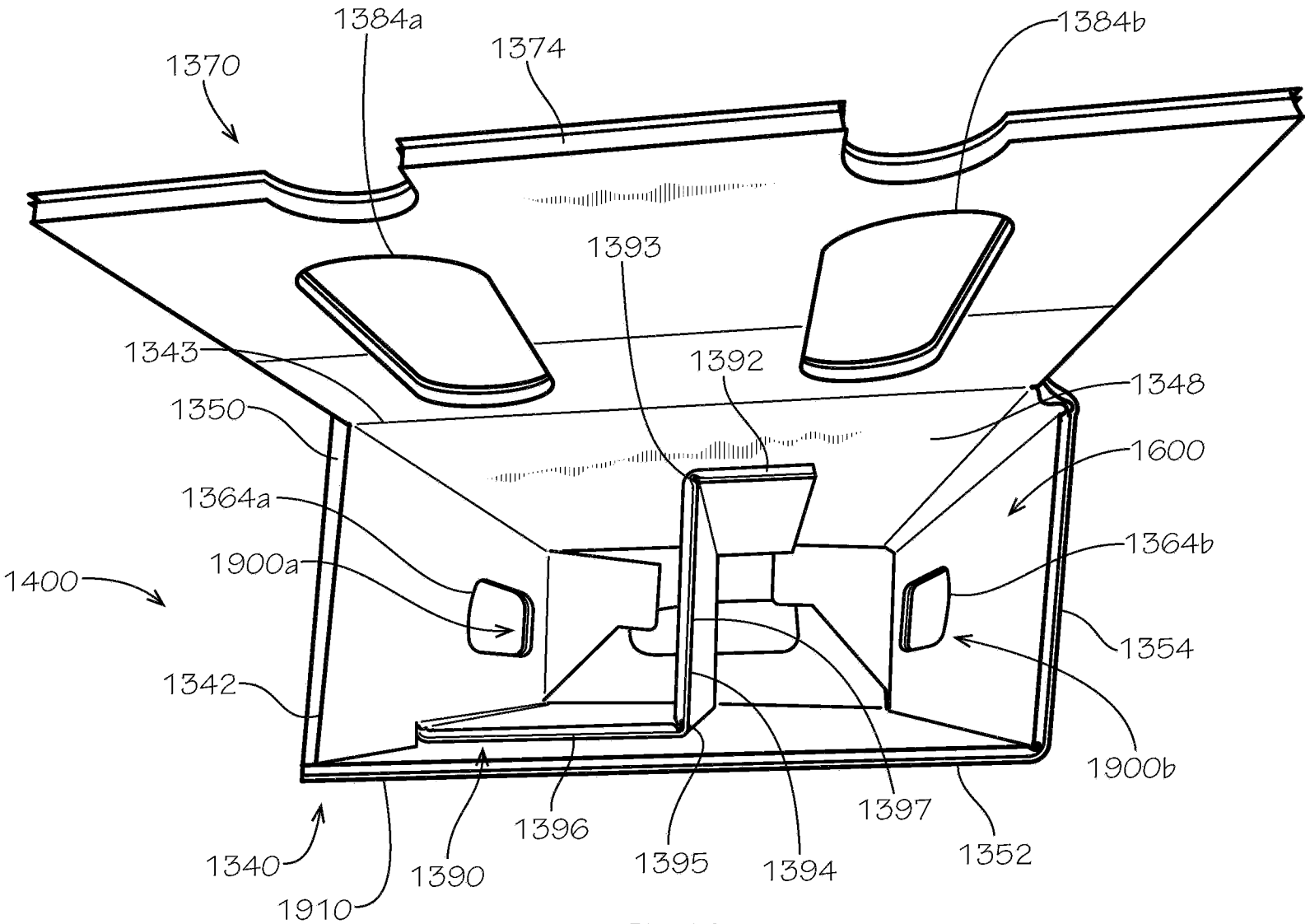
FIG. 19 is a top view of the box of FIG. 14 in the erected configuration with a top portion of the box in an open configuration.

FIG. 19 is a top view of the box 1400 in the erected configuration with the top portion 1370 in an open configuration. The body top end 1342 can define an opening 1910 to the cavity 1600. In the open configuration, the top portion 1370 does not obstruct or cover the opening 1910, and the telescoping panel 1374 is positioned external to the cavity 1600. For example, the telescoping panel 1374 can either be aligned substantially parallel with the front panel 1348 or folded about the top hinge 1343 outwards and away from the opening 1910.

As shown through the opening 1910, the coupling portion 1390 can partition the cavity 1600 into two cells 1900*a,b*. Specifically, the partition panel 1394 can partition the cavity 1600 into two cells 1900*a,b*. The first coupling panel 1392 and the second coupling panel 1396 can respectively be coupled to and positioned substantially parallel to the front panel 1348 and the rear panel 1352. The first coupling hinge 1393 and the second coupling hinge 1395 can be folded, and the partition panel 1394 can extend from the front panel 1348 to the rear panel 1352. In the present aspect, the partition panel 1394 can be substantially perpendicular to the front panel 1348 and the rear panel 1352 in the erected configuration, and the coupling hinges 1393, 1395 can be folded approximately 90-degrees. In other aspects, the coupling hinges 1393, 1395 can be folded to greater than or less than 90-degrees, and the coupling hinges 1393, 1395 can define acute or obtuse angles in the erected configuration.

The viewing ports 1364*a,b* in the side panels 1350, 1354 can provide visibility into the cells 1900*a,b*, respectively. Additionally, the clearance slots 1384*a,b* can respectively align with the cells 1900*a,b*. The coupling portion top end 1397 can be positioned below the opening 1910.

Figure 20:
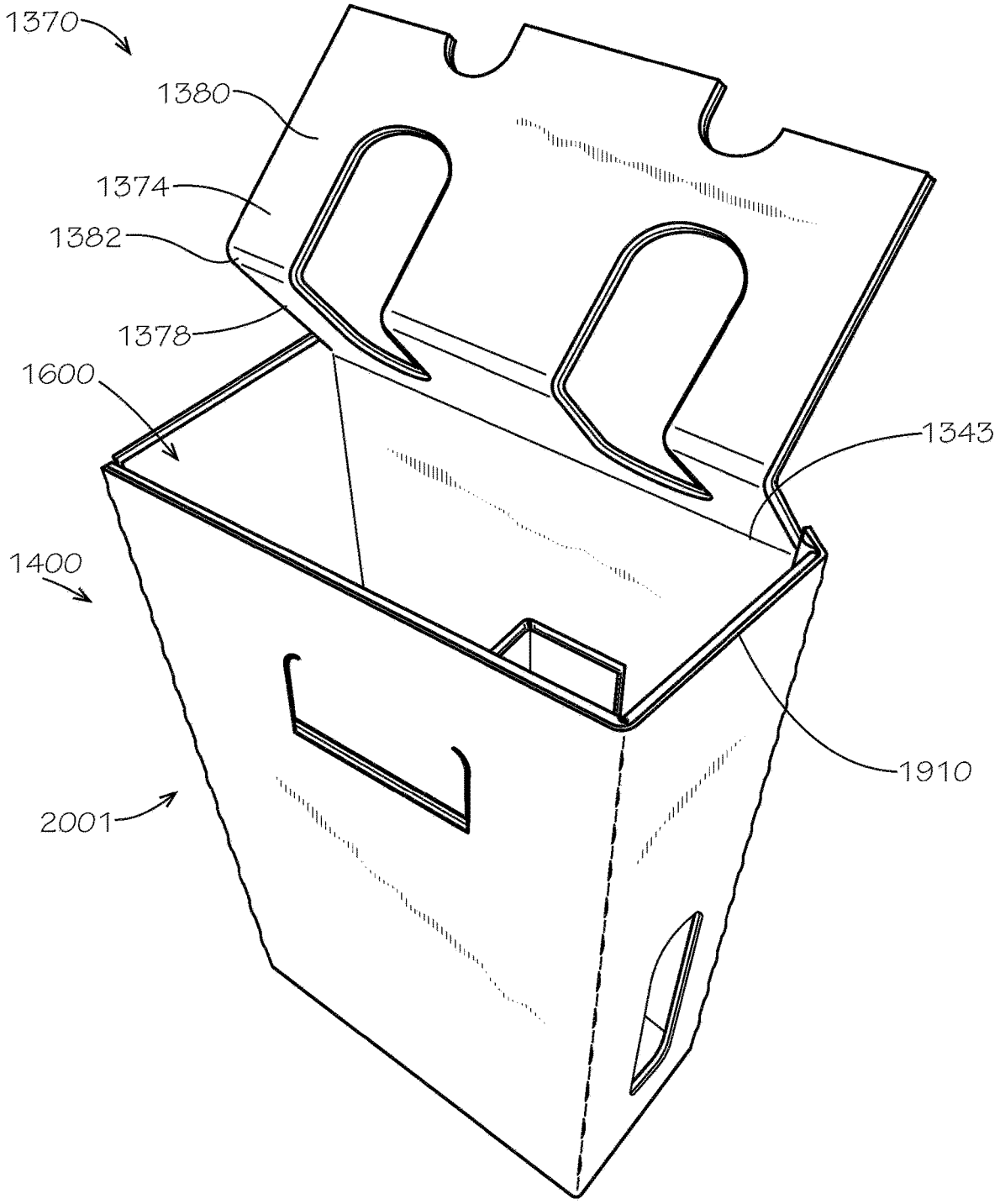
FIG. 20 is a rear perspective view of the box of FIG. 14 demonstrating a first step in reconfiguring the top portion from the open configuration to a closed configuration.
Figure 21:
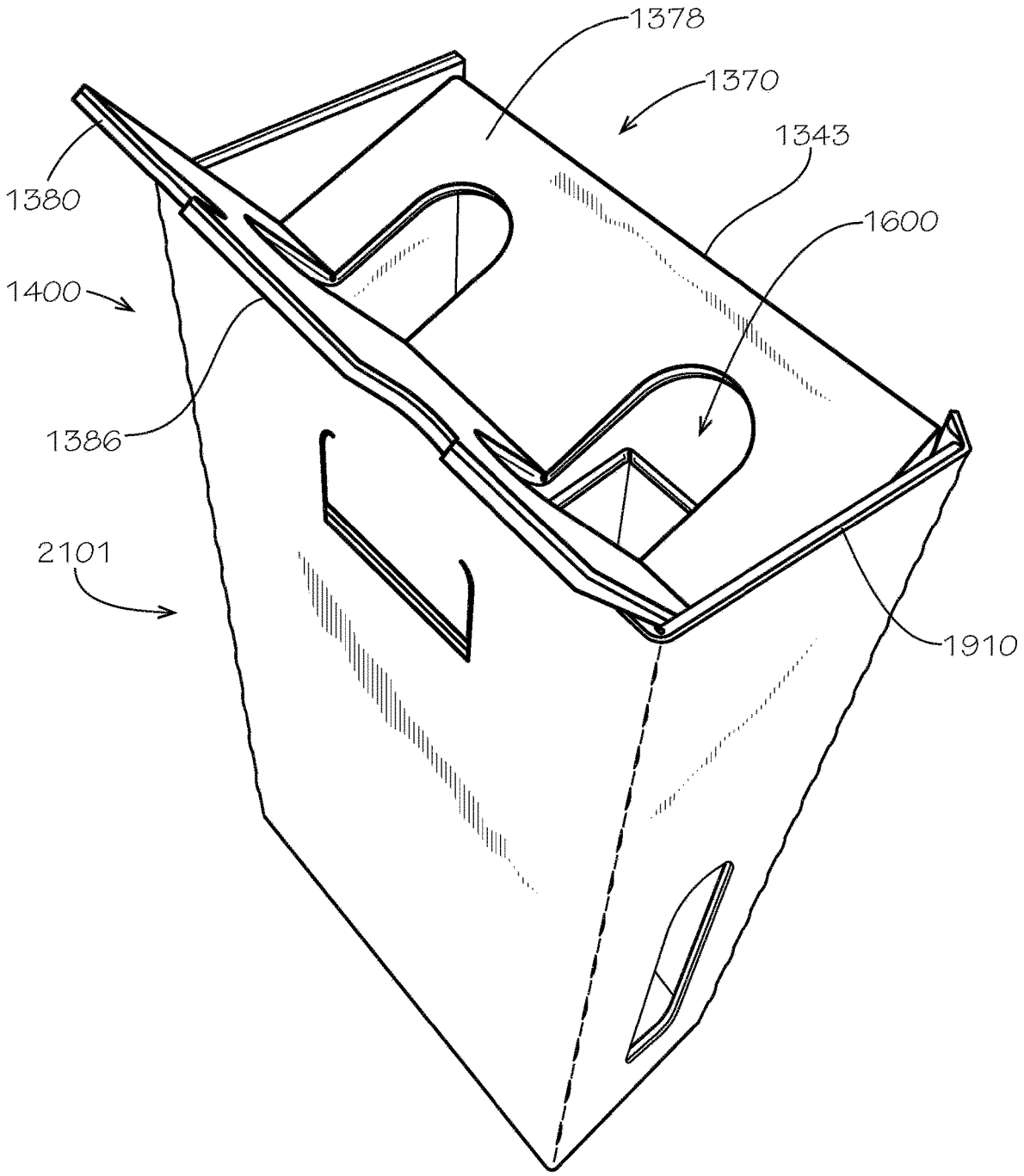
FIG. 21 is a rear perspective view of the box of FIG. 14 demonstrating a second step in reconfiguring the top portion from the open configuration to the closed configuration.
Figure 22:
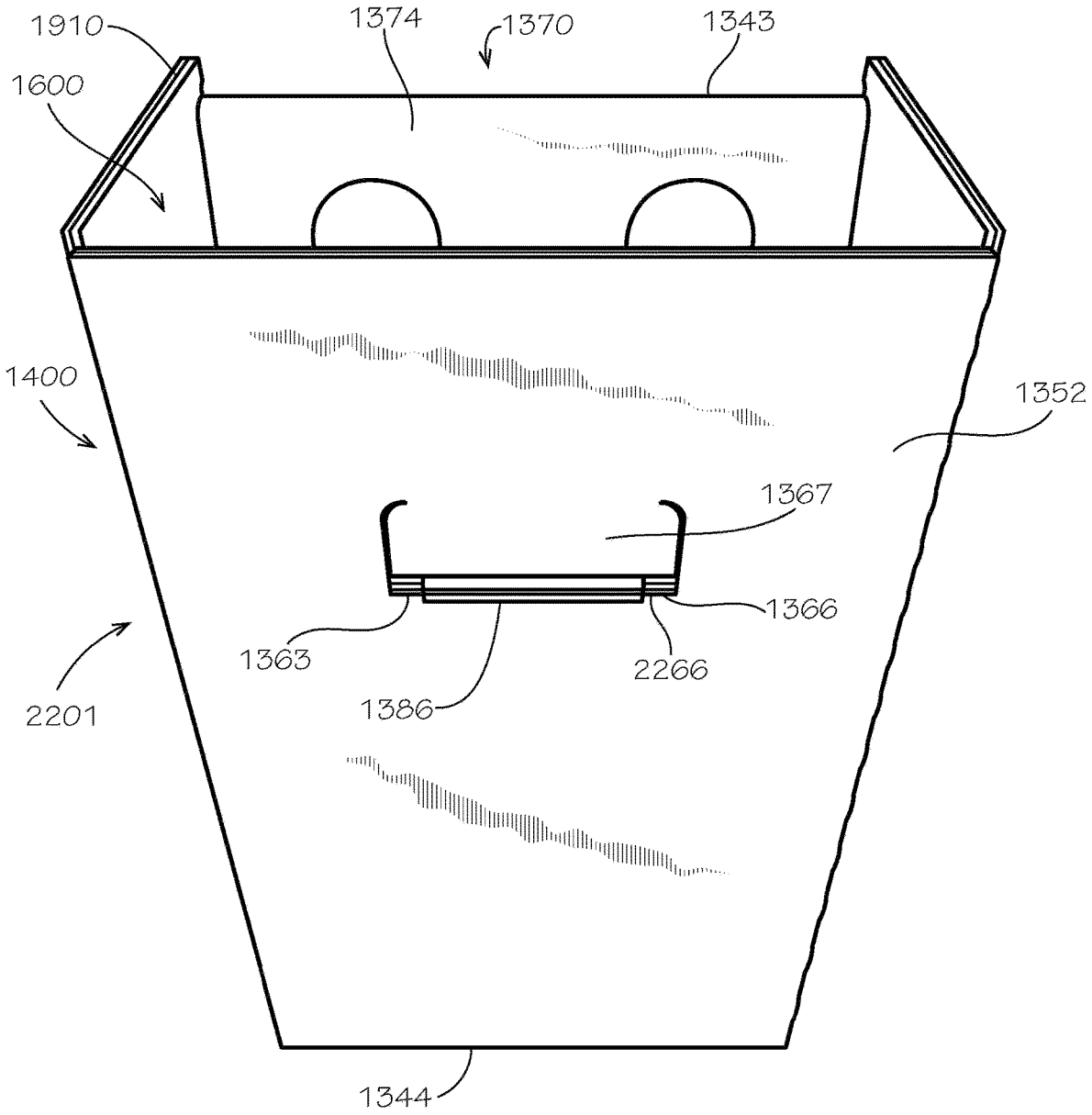
FIG. 22 is a rear view of the box of FIG. 14 demonstrating a third step in reconfiguring the top portion from the open configuration to the closed configuration.
Figure 23:
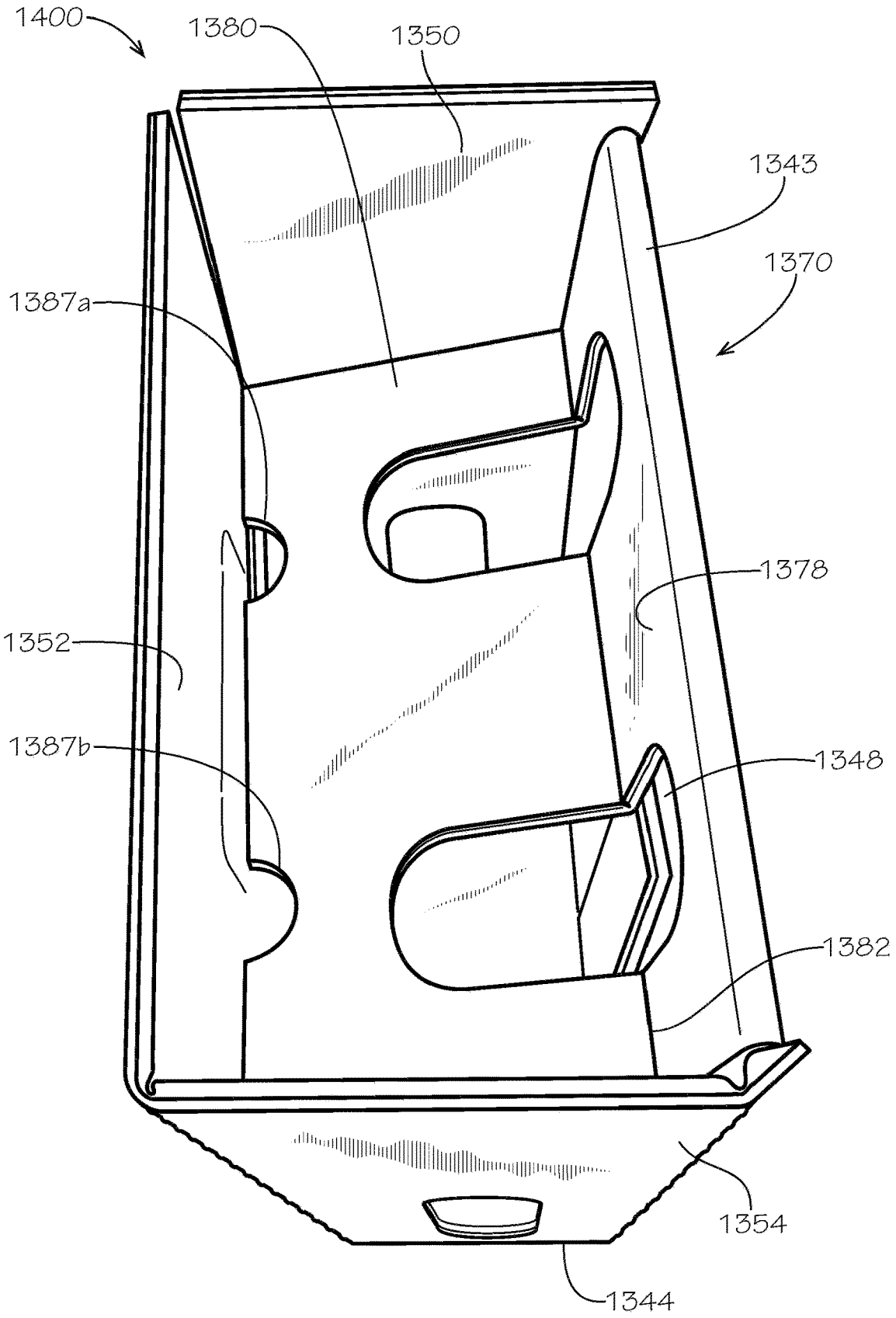
FIG. 23 is a top side view of the box of FIG. 14 with the top portion in the closed configuration.
Figure 24:
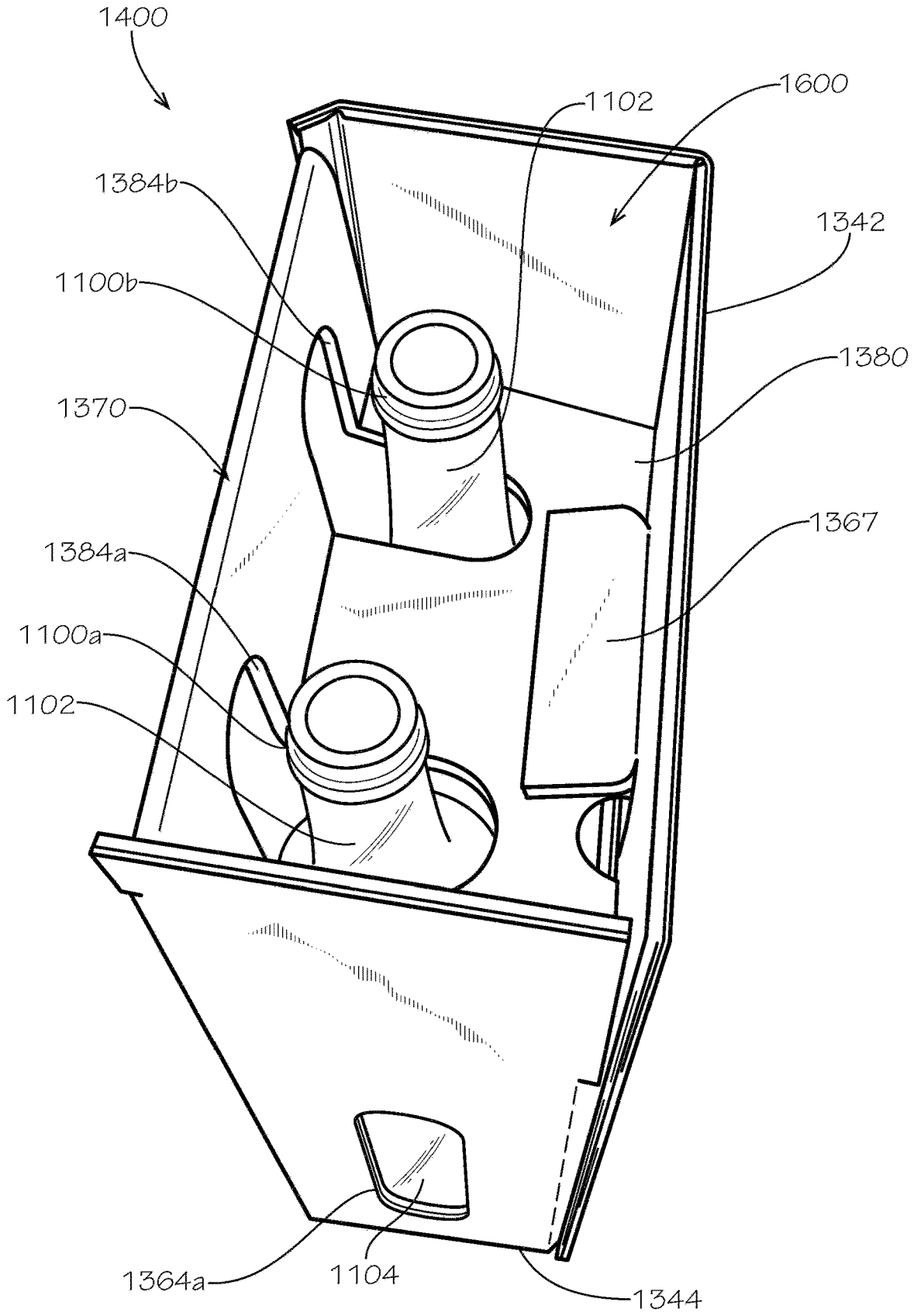
FIG. 24 is a top side view of the box of FIG. 14 with the top portion in the closed configuration and two containers positioned within a cavity defined by the box.

FIGS. 20-22 demonstrate a process for reconfiguring the top portion 1370 from the open configuration shown in FIG. 19 to a closed configuration shown in FIGS. 22-24. FIG. 20 is a rear perspective view of the box 1400 of FIG. 14 demonstrating a first step 2001 in reconfiguring the top portion 1370 from the open configuration to the closed configuration. FIG. 21 is a rear perspective view of the box 1400 of FIG. 14 demonstrating a second step 2101 in reconfiguring the top portion 1370 from the open configuration to the closed configuration. FIG. 22 is a rear view of the box 1400 of FIG. 14 demonstrating a third step 2201 in reconfiguring the top portion 1370 from the open configuration to the closed configuration.

As shown in FIG. 20, in step 2001, the lower telescoping subpanel 1378 of the telescoping panel 1374 can be folded downwards about the top hinge 1343 towards the opening 1910 to the cavity 1600 while the upper telescoping subpanel 1380 can be folded upwards about the telescoping hinge 1382 and away from the opening 1910.

In step 2101, as shown in FIG. 21, the lower telescoping subpanel 1378 can be folded through the opening 1910 and into the cavity 1600 about the top hinge 1343. The upper telescoping subpanel 1380 can be positioned partially below the opening 1900, while the locking tab 1386 can be positioned external to the cavity 1600.

In step 2201, illustrated in FIG. 22, the telescoping panel 1374 can be fully folded about the top hinge 1343 into the cavity 1600 through the opening 1910. As the telescoping panel 1374 is folded inwards, the locking tab 1386 can slide down the rear panel 1352 until it contacts the locking notch knockout 1365 (shown in FIG. 13) and dislodges the locking notch knockout 1365 from the locking notch cut 1366 to form a locking notch 2266. The locking tab 1386 can then engage the locking notch 2266 to secure the telescoping panel 1374 and the top portion 1370 in the closed configuration between the bottom edge 1363 of the locking notch cut 1366 and the finger flap 1367. In this manner, the telescoping panel 1374 can telescope from the open configuration outside of the cavity 1600 to the closed configuration wherein the telescoping panel 1374 is positioned within the cavity 1600, and the telescoping panel 1374 at least partially encloses a portion of the cavity 1600 between the upper telescoping subpanel 1380 (shown in FIG. 21) and the body bottom end 1344. In aspects comprising top flaps (not shown), similar to the top flaps 172,176 of FIG. 1, the top flaps can then be folded towards one another and secured over the opening 1910, similar to step 1201 shown in FIG. 12.

FIG. 23 is top side view of the box 1400 with the top portion 1370 in the closed configuration. In the closed configuration, the lower telescoping subpanel 1378 can be positioned in facing engagement with the front panel 1348, substantially parallel to panels 1348, 1352 and substantially perpendicular to the side panels 1350, 1354. The lower telescoping subpanel 1378 can be folded approximately 180-degrees about the top hinge 1343. The upper telescoping subpanel 1380 can be folded about the telescoping hinge 1382 relative to the lower telescoping subpanel 1378, and the upper telescoping subpanel 1380 can extend from the front panel 1348 to the rear panel 1352. In some aspects, the upper telescoping subpanel 1380 can be folded approximately 90-degrees about the telescoping hinge 1382 relative to the lower telescoping subpanel 1378, and the upper telescoping subpanel 1380 can be substantially perpendicular to the front panel 1348 and the rear panel 1352. In some aspects, the upper telescoping subpanel 1380 can be folded more or less than 90-degrees about the telescoping hinge 1382 relative to the lower telescoping subpanel 1378, and an acute or obtuse angle can be defined between the upper telescoping subpanel 1380 and the lower telescoping subpanel 1378.

The clearance cuts 1387*a,b* can allow a user to insert one or more fingers between the upper telescoping subpanel 1380 and the rear panel 1352 so that the user can pull the upper telescoping subpanel 1380 away from the rear panel 1352 to disengage the locking tab 1386 (shown in FIG. 22) from the locking notch 2266 (shown in FIG. 22). Once disengaged, the user can then reconfigure the top portion 1370 to the open configuration. When engaged, the locking tab 1386 and the locking notch 2266 can resist reconfiguration of the telescoping panel 1374 back towards the open configuration if an upward force is applied to the upper telescoping subpanel 180.

This can be desirable, as demonstrated by FIG. 24, when the box 1400 contains containers 1100*a,b*, which can be substantially the same as container 1100 from FIG. 11. As discussed with respect to FIG. 19, the cavity 1600 can define two cells 1900*a,b* (shown in FIG. 19) shaped to respectively receive the containers 1100*a,b*. The reduced necks 1102 of the containers 1100*a,b* can extend through a portion of the clearance slots 1384*a,b* defined by the upper telescoping subpanel 1380. The reduced necks 1102 can be positioned between the upper telescoping subpanel 1380 and the body top end 1342, and the barrel 1104 (as shown by container 1100*a*) can be positioned between the upper telescoping subpanel 1380 and the body bottom end 1344. Interference between the containers 1100*a,b* and the upper telescoping subpanel 1380 can prevent upwards and downwards motion of the containers 1100*a,b* within the cavity 1600. This can be desirable where the box 1400 is used for shipping the containers 1100*a,b*, for example and without limitation. The barrels 1104 of the containers 1100*a,b* can be respectively viewed through the viewing ports 1364*a,b* (1364*b* shown in FIG. 13), such as to identify the contents of the containers 1100*a,b*.

The finger flap 1367 can be folded inwards from the finger cutout 1369 (shown in FIG. 13) and into the cavity 1600 to permit a user to insert one or more fingers to aid in carrying the box 1400. With the finger flap 1637 folded inwards, the finger flap 1637 can also resist upward motion of the upper telescoping subpanel 1380, thereby preventing inadvertent reconfiguration of the top portion 1370 from the closed configuration to the open configuration.

The orientations of the top portions 170, 1370 and bottom portions 110, 1310 relative to one another and relative to the body portions 140, 1340 should not be viewed as limiting. For example, referring to blank 100 in FIG. 1, the top flaps 172, 176 can be coupled to the side panels 150, 154, the telescoping panel 174 can be coupled to the front panel 148, and the locking notch 166 can be defined by the rear panel 152 in some aspects, for example and without limitation. In other aspects of the blank 100, the telescoping panel 174 can be coupled to the second side panel 154, and the first side panel 150, for example and without limitation. In other words, different flaps from of the top portion 170 and bottom portion 110 can be coupled to different panels of the body portion 140 so long as the spatial and functional relationships between flaps of the respective portions 110, 170 are preserved, including placement of the locking notch 166 relative to the telescoping panel 174.

Likewise, referring to the blank 1300 of FIG. 13, the telescoping panel 1374 can be coupled to the rear panel 1352, and the locking notch 166 can be defined by the front panel 1348 in some aspects. The relationship of the bottom portion 1310 relative to the body portion 1340 can also be altered, so that the bottom tab flap 1316 can be coupled to the rear panel 1352, the bottom notch flap 1312 can be coupled to the front panel 1348, and the orientation of the bottom side flaps 1314, 1318 can be reversed.

In the present aspects, the blanks 100, 1300 can comprise corrugated cardboard; however, in other aspects, the blanks 100, 1300 can comprise a different material, such as plastic sheeting, corrugated plastic sheeting, posterboard, or any other suitable sheet material or film material.

As discussed above with respect to FIGS. 1 and 13, the blanks 100 (shown in FIG. 1) can define numerous hinges 143, 145, 156, 158, 160, 162, 182, 1343, 1344, 1356, 1358, 1360, 1362, 1382, 1393, 1395. Each of these hinges can be formed from any of numerous techniques, such as scoring, perforating, creasing, or any other suitable technique to create a line of weakness in the material of the respective blank 100, 1300. Additionally, each hinge may comprise multiple lines of weakness, such as adjacent parallel scored, creased, or perforated lines or a combination thereof, such as to facilitate folds of greater than 90-degrees. Additionally, relief cuts can be made in the hinges. Multiple lines of weakness and relief cuts can reduce the stresses in the material where the hinges are folded to form an acute angle between adjacent panels or even 180-degrees angles wherein adjacent panels are positioned in facing engagement with one another.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A box comprising:

a body portion comprising a front portion, a rear portion, a first side portion, and a second side portion, the body portion at least partially defining a cavity; and a telescoping panel comprising:

a lower telescoping subpanel coupled to the body portion by a top hinge and extending into the cavity; and an upper telescoping subpanel coupled to the lower telescoping subpanel by a telescoping hinge and extending across the cavity, wherein in a collapsed configuration, every other hinge is folded.

2. The box of claim 1, wherein the front portion, the rear portion, the first side portion, and the second side portion are each separated by four hinges, and in the collapsed configuration, two pairs of adjacent panels of the body portion are positioned in facing engagement with one another.

3. The box of claim 1, wherein in an erected configuration, each body portion is perpendicular to an adjacent body portion and coupled by hinges, and each of the hinges is oriented in a perpendicular configuration.

4. The box of claim 1, wherein the telescoping panel defines a clearance slot extending across the telescoping hinge and through the lower telescoping subpanel and the upper telescoping subpanel, and wherein the clearance slot is sized to receive a neck of a container when the container is positioned within the cavity.

5. The box of claim 1, wherein at least one body panel of the body portion comprises a notch that receives a locking tab on an upper telescoping subpanel of the telescoping panel in an erected configuration.

6. The box of claim 1, further comprising a viewing port that extends across a plurality of body portions and at least one hinge.

7. The box of claim 1, further comprising a bottom portion coupled to a bottom of the body portion by a bottom hinge, the bottom portion comprising:

a bottom notch flap defining a notch;

a pair of bottom side flaps folded at least partially over the bottom notch flap; and a bottom tab flap defining a locking tab, the bottom tab flap folded at least partially over each bottom side flap, the locking tab engaging the notch.

8. The box of claim 1, wherein:

the front portion comprises a notch positioned opposite from the rear portion of the body portion; and the telescoping panel comprises a locking tab and the telescoping panel is coupled to the rear portion and extends across the cavity from the rear portion to the front portion, wherein the locking tab of the telescoping panel engages the notch on the front portion.

9. A box comprising:

a body portion comprising body panels separated by hinges, in a collapsed configuration, the body portion is folded about half of the hinges wherein every other hinge is folded, and in an erected configuration, each body panel is folded about an adjacent hinge to define a cavity; and a telescoping panel comprising an upper telescoping subpanel and a lower telescoping subpanel, the lower telescoping subpanel coupled to one of the body panels of the body portion by a top hinge and extending into the cavity and positioned in facing engagement with a first panel of the body panels, the upper telescoping subpanel coupled to the lower telescoping subpanel by a telescoping hinge and extending across the cavity.

10. The box of claim 9, wherein the body portion comprises four body panels separated by four hinges and in the collapsed configuration two pairs of adjacent panels are positioned in facing engagement with one another.

11. The box of claim 9, wherein the body portion comprises a front panel, a rear panel, a first side panel, and a second side panel, wherein the front panel is positioned opposite from the rear panel, and wherein the telescoping panel is coupled to the rear panel and extends through the cavity from the rear panel to the front panel.

12. The box of claim 9, wherein in the erected configuration, each body panel is perpendicular to an adjacent body panel, and each of the hinges is oriented in a perpendicular configuration.

13. The box of claim 9, wherein the telescoping panel defines a clearance slot extending across the telescoping hinge and through the lower telescoping subpanel and the upper telescoping subpanel, and wherein the clearance slot is sized to receive a neck of a container when the container is positioned within the cavity.

14. The box of claim 9, wherein at least one body panel of the body portion comprises a notch that receives a locking tab of the upper telescoping subpanel in the erected configuration.

15. The box of claim 9, further comprising a viewing port that extends across a plurality of body panels and at least one hinge in the erected configuration.

16. The box of claim 9, further comprising a bottom portion folded to enclose a bottom end of the body portion, the bottom portion comprising a bottom notch flap folded at a perpendicular angle about a bottom hinge coupled to one of the body panels and a pair of bottom side flaps folded over the bottom notch flap.

17. The box of claim 16, wherein each of the pair of bottom side flaps comprises a side tab and the bottom notch flap comprises a notch, and wherein the side tab of each of the pair of bottom side flaps covers the notch defined by the bottom notch flap.

18. A method of erecting a box comprising:

positioning a body portion comprising a front portion, a rear portion, a first side portion, and a second side portion coupled by a plurality of hinges such that when each portion is perpendicular to an adjacent portion and the body portion at least partially defines a cavity; and orienting a telescoping panel comprising a lower telescoping subpanel coupled to the body portion by a top hinge and extending into the cavity and an upper telescoping subpanel comprising a locking tab coupled to a notch in the body portion; wherein:

in a collapsed configuration, the body portion is folded about half of the hinges, and every other hinge is folded; and in an erected configuration, each body panel is folded about an adjacent hinge to define the cavity.

19. A box comprising:

a body portion comprising a front portion, a rear portion, a first side portion, and a second side portion, the body portion at least partially defining a cavity, the front portion, rear portion, first side portion, and the second side portion each separated by one of four hinges, wherein in a collapsed configuration, two pairs of adjacent panels of the body portion are positioned in facing engagement with one another; and a telescoping panel comprising:

a lower telescoping subpanel coupled to the body portion by a top hinge and extending into the cavity; and an upper telescoping subpanel coupled to the lower telescoping subpanel by a telescoping hinge and extending across the cavity.

20. A box comprising:

a body portion comprising four body panels separated by hinges, in a collapsed configuration, the body portion is folded about half of the hinges and two pairs of adjacent panels are positioned in facing engagement with one another, and in an erected configuration, each body panel is folded about an adjacent hinge to define a cavity; and a telescoping panel comprising an upper telescoping subpanel and a lower telescoping subpanel, the lower telescoping subpanel coupled to one of the four body panels of the body portion by a top hinge and extending into the cavity and positioned in facing engagement with a first panel of the four body panels, the upper telescoping subpanel coupled to the lower telescoping subpanel by a telescoping hinge and extending across the cavity.

* * * * *